US005481651A

United States Patent [19]

Herold

[11] Patent Number: 5,481,651

[45] Date of Patent: Jan. 2, 1996

[54] METHOD AND APPARATUS FOR MINIMIZING MEAN CALCULATION RATE FOR AN ACTIVE ADDRESSED DISPLAY

[75] Inventor: Barry W. Herold, Boca Raton, Fla.

[73] Assignee: Motorola, Inc., Schaumburg, Ill.

[21] Appl. No.: 51,913

[22] Filed: Apr. 26, 1993

[51] Int. Cl.[6] ..... G09G 1/14

[52] U.S. Cl. ..... 345/94; 345/100; 345/211

[58] Field of Search ..... 340/723, 728, 340/731, 735, 812; 400/121; 382/47, 9; 395/143; 358/433; 345/94, 100, 211

[56] References Cited

U.S. PATENT DOCUMENTS

| | | | |
|---|---|---|---|
| 4,494,144 | 1/1985 | Brown | 382/9 |
| 4,555,191 | 11/1985 | Gojo | 340/728 |
| 4,718,101 | 1/1988 | Ariga | 382/9 |
| 4,831,659 | 5/1989 | Miyaoka | 358/433 |
| 4,881,069 | 10/1989 | Kameda | 340/731 |
| 4,952,036 | 8/1990 | Gulick et al. . | |
| 5,060,036 | 10/1991 | Choi . | |
| 5,097,518 | 3/1992 | Scott | 382/47 |

OTHER PUBLICATIONS

Tandy, "Going Ahead with Extended Color Basic" Ft. Worth, 1981 pp. 20–21.

Gonzales, "Digital Image Processing", 2nd ed Addison–Wesley, 1987 pp. 21–29.

Ruckmongathan, T. N. "A Generalized Addressing Technique for RMS Responding Matrix LCD's", 1988 IDR Conference.

In Focus Systems, Inc. Scheffer, European Patent Application 92102353.7 Feb. 1992, "Gray Level Addressing For LCD's".

Terry Scheffer and Jurgen Nehring, "Supertwisted Nematic (STN) LCDs," May 17, 1992, paper submitted to 1992 SID International Symposium, Boston, Mass.

European Patent Application No. 92102353.7, filed Feb. 1992, by Scheffer et al., entitled "Gray Level Addressing for LCDs".

*Primary Examiner*—Richard Hjerpe
*Assistant Examiner*—Steven J. Saras
*Attorney, Agent, or Firm*—R. Louis Breeden

[57] ABSTRACT

A method and apparatus for minimizing mean calculation rate in a processing system (510) performing active addressing calculations on a frame of data for driving a display (100) having a plurality of electrodes (104, 106) comprise a monitor (700) for monitoring (1506) pixel values in the frame of data to be processed and displayed. A comparator (720) compares (1508) adjacent monitored pixel values to determine (1510) resolution of the data, and thereafter a controller (622) controls (1610, 1612, 1614) the processing system (510) to minimize the mean calculation rate by modifying the active addressing calculations in accordance with the resolution determined.

22 Claims, 15 Drawing Sheets

500

$$\begin{bmatrix} 1 & 1 & 1 & 1 & 1 & 1 & 1 & 1 \\ 1 & 1 & 1 & 1 & -1 & -1 & -1 & -1 \\ 1 & 1 & -1 & -1 & -1 & -1 & 1 & 1 \\ 1 & 1 & -1 & -1 & 1 & 1 & -1 & -1 \\ 1 & -1 & -1 & 1 & 1 & -1 & -1 & 1 \\ 1 & -1 & -1 & 1 & -1 & 1 & 1 & -1 \\ 1 & -1 & 1 & -1 & -1 & 1 & -1 & 1 \\ 1 & -1 & 1 & -1 & 1 & -1 & 1 & -1 \end{bmatrix}$$

300

500

622

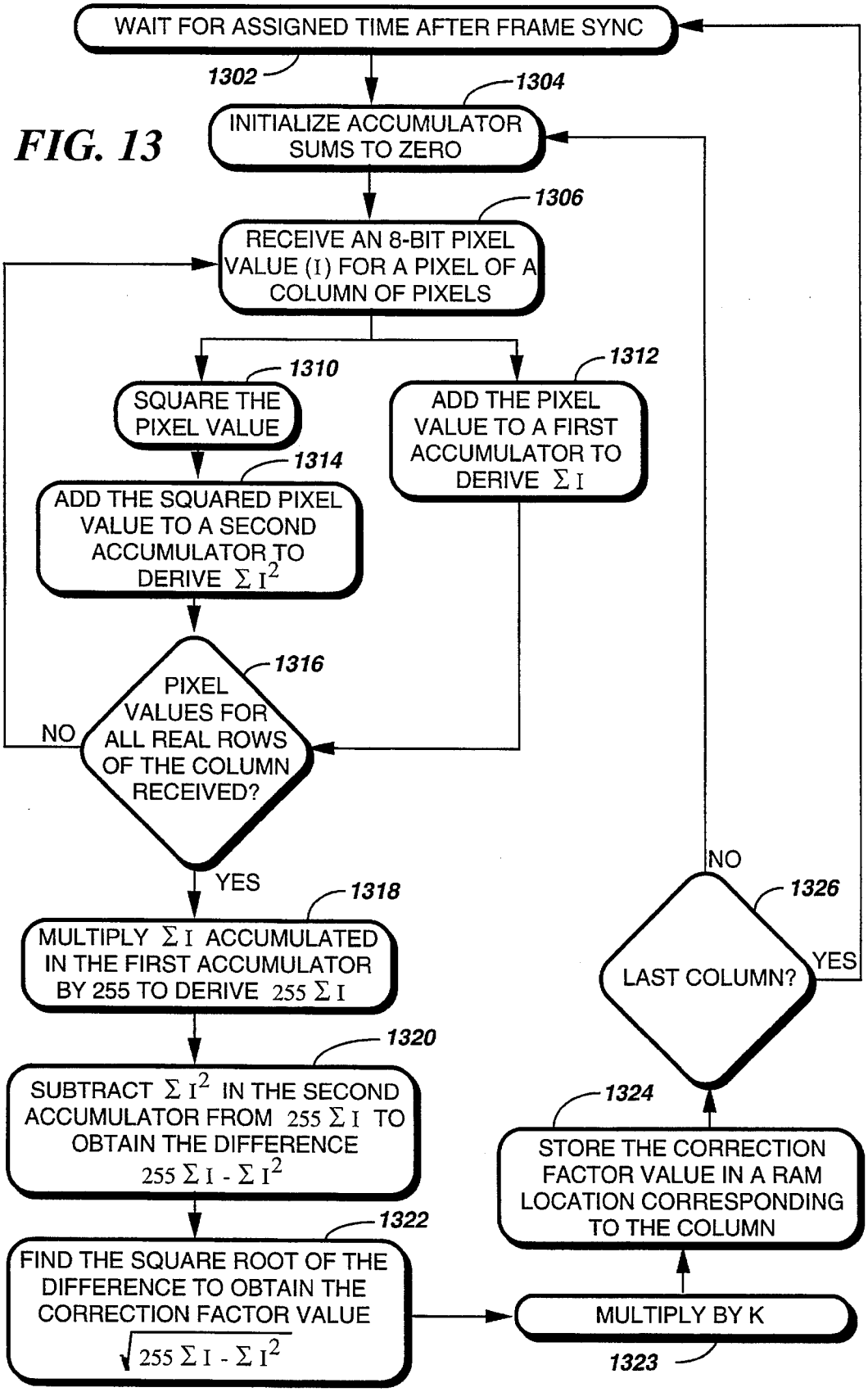
FIG. 13
WAIT FOR ASSIGNED TIME AFTER FRAME SYNC
1302
1304
INITIALIZE ACCUMULATOR SUMS TO ZERO
1306
RECEIVE AN 8-BIT PIXEL VALUE (I) FOR A PIXEL OF A COLUMN OF PIXELS
1310
SQUARE THE PIXEL VALUE
1312
ADD THE PIXEL VALUE TO A FIRST ACCUMULATOR TO DERIVE ΣI
1314
ADD THE SQUARED PIXEL VALUE TO A SECOND ACCUMULATOR TO DERIVE ΣI²
1316
PIXEL VALUES FOR ALL REAL ROWS OF THE COLUMN RECEIVED?
NO
YES
1318
MULTIPLY ΣI ACCUMULATED IN THE FIRST ACCUMULATOR BY 255 TO DERIVE 255 ΣI
1320
SUBTRACT ΣI² IN THE SECOND ACCUMULATOR FROM 255 ΣI TO OBTAIN THE DIFFERENCE 255 ΣI - ΣI²
1322
FIND THE SQUARE ROOT OF THE DIFFERENCE TO OBTAIN THE CORRECTION FACTOR VALUE √(255 ΣI - ΣI²)
MULTIPLY BY K
1323
1324
STORE THE CORRECTION FACTOR VALUE IN A RAM LOCATION CORRESPONDING TO THE COLUMN
1326
LAST COLUMN?
NO
YES

1800

METHOD AND APPARATUS FOR MINIMIZING MEAN CALCULATION RATE FOR AN ACTIVE ADDRESSED DISPLAY

FIELD OF THE INVENTION

This invention relates in general to electronic displays, and more specifically to a method and apparatus for minimizing the mean calculation rate for an active addressed, rms responding display system to reduce power consumption.

BACKGROUND OF THE INVENTION

An example of a direct multiplexed, rms responding electronic display is the well-known liquid crystal display (LCD). In such displays, a nematic liquid crystal material is positioned between two parallel glass plates having electrodes applied to each surface in contact with the liquid crystal material. The electrodes typically are arranged in vertical columns on one plate and horizontal rows on the other plate for driving a picture element (pixel) wherever a column and row electrode overlap. A high information content display, e.g., a display used as a monitor in a portable laptop computer, requires a large number of pixels to portray arbitrary patterns of information. Matrix LCDs having 480 rows and 640 columns forming 307,200 pixels are widely used in computers today, and matrix LCDs with millions of pixels are expected soon.

In so-called rms responding displays, the optical state of a pixel is substantially responsive to the square of the voltage applied to the pixel, i.e., the difference in the voltages applied to the electrodes on the opposite sides of the pixel. LCDs have an inherent time constant that characterizes the time required for the optical state of a pixel to return to an equilibrium state after the optical state has been modified by changing the voltage applied to the pixel. Recent technological advances have produced LCDs with time constants approaching the frame period used in many video displays (approximately 16.7 milliseconds). Such a short time constant allows the LCD to respond quickly and is especially advantageous for depicting motion without noticeable smearing of the displayed image.

Conventional direct multiplexed addressing methods for LCDs encounter a problem when the display time constant approaches the frame period. The problem occurs because conventional direct multiplexed addressing methods subject each pixel to a short duration "selection" pulse once per frame. The voltage level of the selection pulse is typically 7–13 times higher than the rms voltage averaged over the frame period. The optical state of a pixel in an LCD having a short time constant tends to return towards an equilibrium state between selection pulses, resulting in lowered image contrast, because the human eye integrates the resultant brightness transients at a perceived intermediate level. In addition, the high level of the selection pulse can cause alignment instabilities in some types of LCDs.

To overcome the above-described problems, an "active addressing" method has been developed. The active addressing method continuously drives the row electrodes with signals comprising a train of periodic pulses having a common period T corresponding to the frame period. The row signals are independent of the image to be displayed and preferably are orthogonal and normalized, i.e., orthonormal. The term orthogonal denotes that if the amplitude of a signal applied to one of the rows is multiplied by the amplitude of a signal applied to another one of the rows, the integral of this product over the frame period is zero. The term normalized denotes that all the row signals have the same rms voltage integrated over the frame period T.

During each frame period a plurality of signals for the column electrodes are calculated and generated from the collective state of the pixels in each of the columns. The column voltage at any time t during the frame period is proportional to the sum obtained by considering each pixel in the column, multiplying a "pixel value" representing the optical state (−1 representing fully "on", +1 representing fully "off", and values between −1 and +1 representing proportionally corresponding gray shades) of the pixel by the value of that pixel's row signal at time t, and adding the products obtained thereby to the sum. If the orthonormal row signals switch between only two row voltage levels (+1 and −1), the above sum may be represented as the sum of the pixel values corresponding to rows having the first row voltage level, minus the sum of the pixel values corresponding to rows having the second row voltage level.

If driven in the active addressing manner described above, it can be shown mathematically that there is applied to each pixel of the display an rms voltage averaged over the frame period, and that the rms voltage is proportional to the pixel value for the frame. The advantage of active addressing is that it restores high contrast to the displayed image, because instead of applying a single, high level selection pulse to each pixel during the frame period, active addressing applies a plurality of much lower level (2–5 times the rms voltage) selection pulses spread throughout the frame period. In addition, the much lower level of the selection pulses substantially reduces the probability of alignment instabilities.

A problem with active addressing results from the large number of calculations required per second. For example, a gray scale display having 480 rows and 640 columns, and a frame rate of 60 frames per second requires just under ten billion calculations per second. While it is of course possible with today's technology to perform calculations at that rate, the architectures proposed to date for calculation engines used for actively addressed displays have not been optimized to minimize power consumption. The power consumption issue is particularly important in portable applications, such as battery-powered laptop computers, in which battery life is a primary design consideration.

Thus, what is needed is a method and apparatus for controlling and driving an actively addressed display in a manner that minimizes the mean calculation rate and thus also minimizes the power consumption of the required calculation engine.

SUMMARY OF THE INVENTION

An aspect of the present invention is a method in a processing system which generates drive signals for driving an active addressed display during a plurality of active addressing time slots. The display has a plurality of electrodes, and the drive signals are derived from electrical signals received by the processing system. The electrical signals comprise a received frame of data representing optical states of pixels of an image displayed by the active addressed display. The method enables a minimization of power consumption of the processing system. The method comprises the steps of monitoring, in a resolution monitor of the processing system, pixel values in the received frame of data to be processed and displayed, and comparing, by the resolution monitor, adjacent monitored pixel values grouped into groups of equal length to measure resolution of the received frame of data. The method further comprises the step of thereafter modifying active addressing calculations utilized for driving the display in accordance with the resolution measured, to reduce power consumption of the processing system by permitting use of a reduced number of drive signals and a correspondingly reduced number of the active addressing calculations required. This is done in response to the resolution of the received frame of data being such that modifying the active addressing calculations will have no effect on displayed resolution of the image. The modifying step comprises the steps of grouping by a controller, directed by grouper firmware, adjacent ones of the plurality of electrodes in accordance with the resolution measured for the received frame of data, the grouping being utilized for displaying the received frame of data in its entirety; and loading a driver, in accordance with drive manager firmware, with the grouped adjacent ones of the plurality of electrodes for generating a plurality of common drive signals for driving the active addressed display.

Another aspect of the present invention is an apparatus for minimizing power consumption of a processing system which generates drive signals for driving an active addressed display during a plurality of active addressing time slots. The display has a plurality of electrodes, and the drive signals are derived from electrical signals received by the processing system. The electrical signals comprise a received frame of data representing optical states of pixels of an image displayed by the active addressed display. The apparatus comprises a resolution monitor for monitoring pixel values in the received frame of data to be processed and displayed, and a comparator coupled to the resolution monitor for comparing adjacent monitored pixel values grouped into groups of equal length to measure resolution of the received frame of data. The apparatus further comprises a driver coupled to a controller for driving the active addressed display, and the controller coupled to the comparator for modifying active addressing calculations utilized for driving the display in accordance with the resolution measured, to reduce power consumption of the processing system by permitting use of a reduced number of drive signals and a correspondingly reduced number of the active addressing calculations required. This is done in response to the resolution of the received frame of data being such that modifying the active addressing calculations will have no effect on displayed resolution of the image. The controller comprises a grouper for grouping adjacent ones of the plurality of electrodes in accordance with the resolution measured for the received frame of data, the grouping being utilized for displaying the received frame of data in its entirety, and a drive manager coupled to the grouper for loading a driver with the grouped adjacent ones of the plurality of electrodes for generating a plurality of common drive signals for driving the active addressed display.

Another aspect of the present invention is an electronic device, comprising electronic circuitry for generating electrical signals comprising a received frame of data having a resolution, the received frame of data representing optical states of pixels of an image displayed by an active addressed display, and an enclosure coupled to the electronic circuitry for supporting and protecting the electronic circuitry. The electronic device further comprises the active addressed display coupled to the electronic circuitry for displaying information therefrom, wherein the active addressed display comprises pixels controlled by a plurality of electrodes; and a processing system coupled to the electronic circuitry, the processing system developing drive signals from the electrical signals, the drive signals for driving the active addressed display during a plurality of active addressing time slots. The electronic device also includes an apparatus for minimizing power consumption of the processing system. The apparatus comprises a monitor for monitoring pixel values in the received frame of data, and a comparator coupled to the monitor for comparing adjacent monitored pixel values grouped into groups of equal length to measure the resolution of the received frame of data. The apparatus further comprises a driver coupled to a controller for driving the active addressed display, and the controller coupled to the comparator for modifying active addressing calculations utilized for driving the display in accordance with the resolution measured by the comparator, to reduce power consumption of the processing system by permitting use of a reduced number of drive signals and a correspondingly reduced number of the active addressing calculations required. This is done in response to the resolution of the received frame of data being such that modifying the active addressing calculations will have no effect on displayed resolution of the image. The controller comprises a grouper for grouping adjacent ones of the plurality of electrodes in accordance with the resolution measured, the grouping being utilized for displaying the received frame of data in its entirety, and a drive manager coupled to the grouper for loading the driver with the grouped adjacent ones of the plurality of electrodes for generating a plurality of common drive signals for driving the active addressed display.

BRIEF DESCRIPTION OF THE DRAWINGS

FIG. 13 is a flow chart depicting the operation of the rms correction factor calculator in accordance with the preferred embodiment of the present invention.

DESCRIPTION OF THE PREFERRED EMBODIMENT

Figure 1:
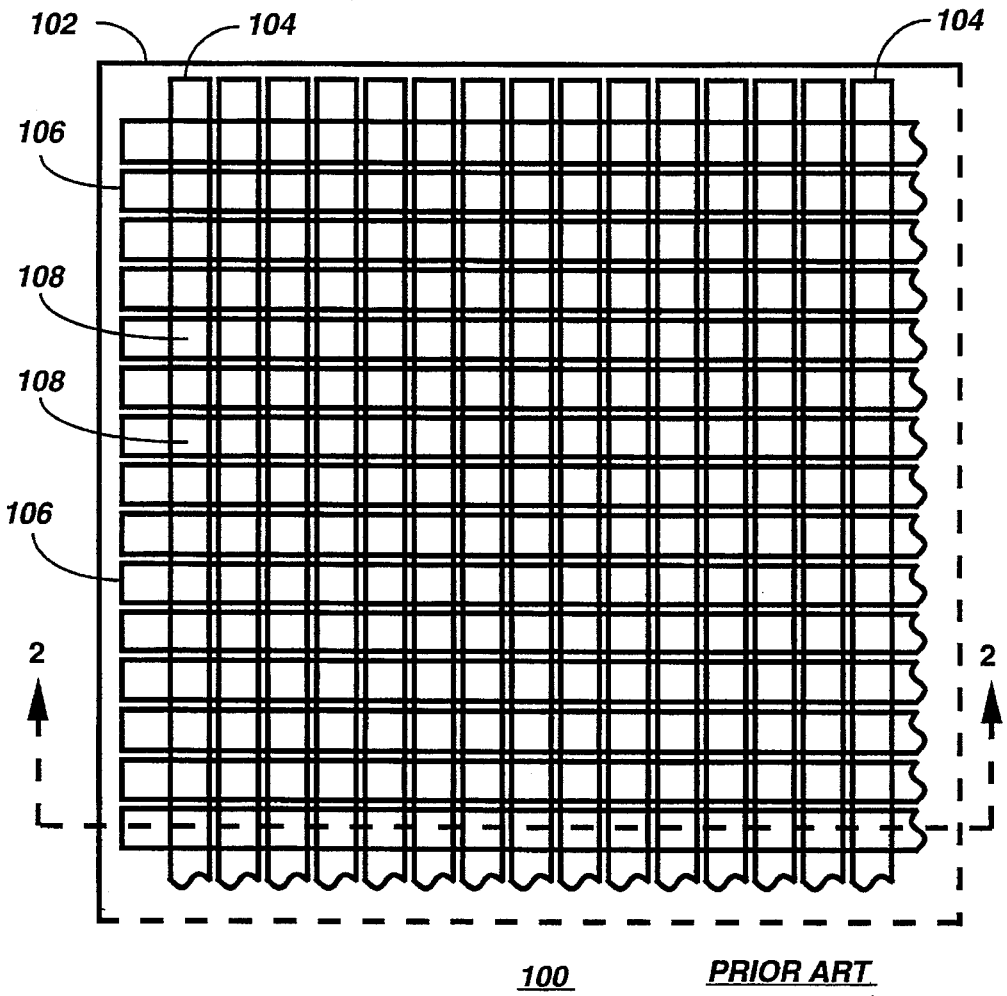
FIG. 1 is a front orthographic view of a portion of a conventional liquid crystal display.
Figure 2:
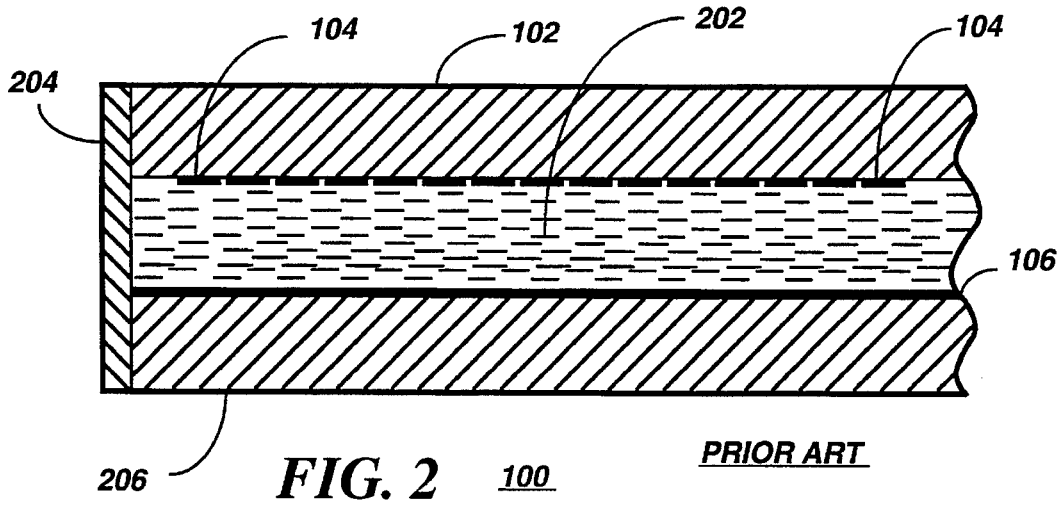
FIG. 2 is an orthographic cross-section view along the line 2—2 of FIG. 1 of the portion of the conventional liquid crystal display.

Referring to FIGS. 1 and 2, orthographic front and cross-section views of a portion of a conventional liquid crystal display (LCD) 100 depict first and second transparent substrates 102, 206 having a space therebetween filled with a layer of liquid crystal material 202. A perimeter seal 204 prevents the liquid crystal material from escaping from the LCD 100. The LCD 100 further includes a plurality of transparent electrodes, comprising row electrodes 106 positioned on the second transparent substrate 206, and column electrodes 104 positioned on the first transparent substrate 102. At each point at which a column electrode 104 overlaps a row electrode 106, such as the overlap 108, voltages applied to the overlapping electrodes 104, 106 can control the optical state of the liquid crystal material 202 therebetween, thus forming a controllable picture element (pixel). While an LCD is the preferred display element in accordance with the preferred embodiment of the present invention, it will be appreciated that other types of display elements may be used as well, provided that such other types of display elements exhibit an optical characteristics responsive to the square of the voltage applied to each pixel, similar to the rms response of an LCD.

Figures 3, 4:
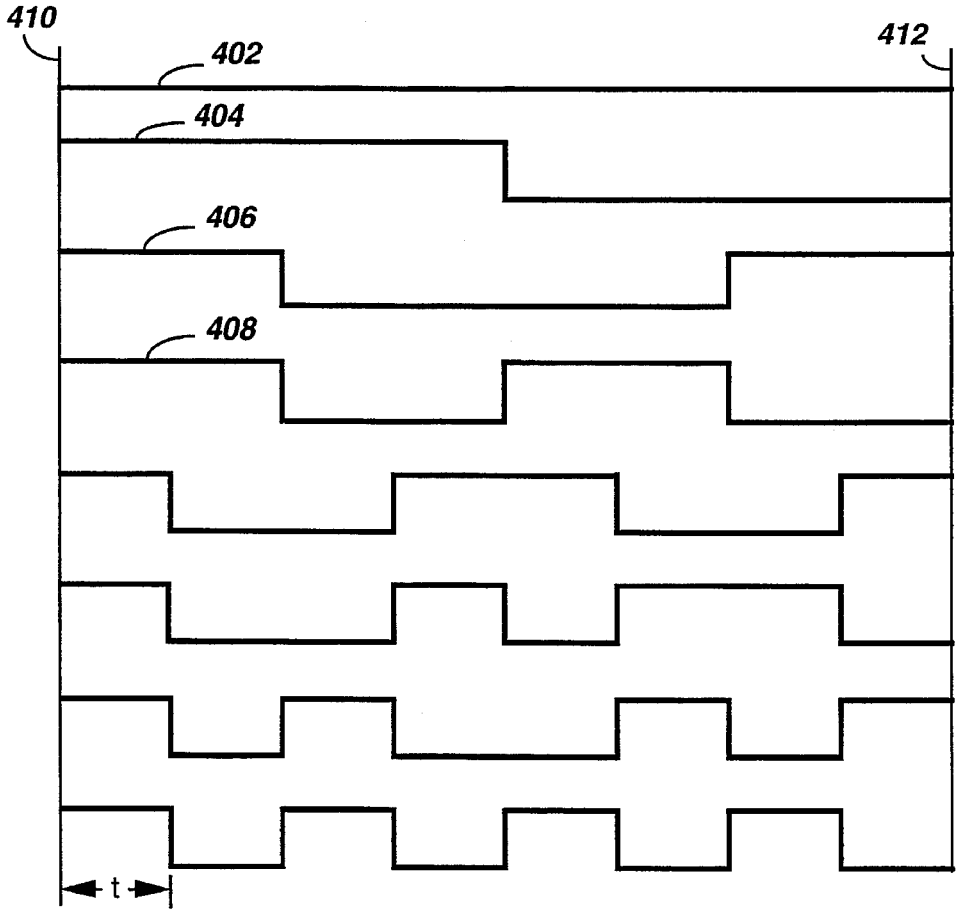
FIG. 3 is an eight-by-eight matrix of Walsh functions in accordance with the preferred embodiment of the present invention.
FIG. 4 depicts drive signals corresponding to the Walsh functions of FIG. 3 in accordance with the preferred embodiment of the present invention.

Referring to FIGS. 3 and 4, an eight-by-eight (third order) matrix of Walsh functions 300 and the corresponding Walsh waves 400 in accordance with the preferred embodiment of the present invention are shown. Walsh functions are orthonormal and are thus preferable for use in an actively addressed display system, as discussed in the Background of the Invention herein above. When used in such a display system, voltages having levels represented by the Walsh waves 400 are uniquely applied to a selected plurality of electrodes of the LCD 100. For example, the Walsh waves 404, 406, and 408 could be applied to the first (uppermost), second, and third row electrodes 106, respectively, and so on. In this manner each of the Walsh waves 400 would be applied uniquely to a corresponding one of the row electrodes 106. It is preferable not to use the Walsh wave 402 in an LCD application, because the Walsh wave 402 would bias the LCD with an undesirable DC voltage.

It is of interest to note that the values of the Walsh waves 400 are constant during each time slot t. The duration of the time slot t for the eight Walsh waves 400 is one-eighth of the duration of one complete cycle of Walsh waves 400 from start 410 to finish 412. When using Walsh waves for actively addressing a display, the duration of one complete cycle of the Walsh waves 400 is set equal to the frame duration, i.e., the time to receive one complete set of data for controlling all the pixels 108 of the display 100.

The eight Walsh waves 400 are capable of uniquely driving up to eight row electrodes 106 (seven if the Walsh wave 402 is not used). It will be appreciated that a practical display has many more rows. For example, displays having four-hundred-eighty rows and six-hundred-forty columns are widely used today in laptop computers. Because Walsh function matrices are available in complete sets determined by powers of two, and because the orthonormality requirement does not allow more than one electrode to be driven from each Walsh wave, a five-hundred-twelve by five-hundred-twelve ($2^9 \times 2^9$) Walsh function matrix would be required to drive a display having four-hundred-eighty row electrodes 106. For this case the duration of the time slot t is 1/512 of the frame duration. Four-hundred-eighty Walsh waves would be used to drive the four-hundred-eighty row electrodes 106, while the remaining thirty-two would be unused, preferably including the first Walsh wave 402 having a DC bias.

Figure 5:
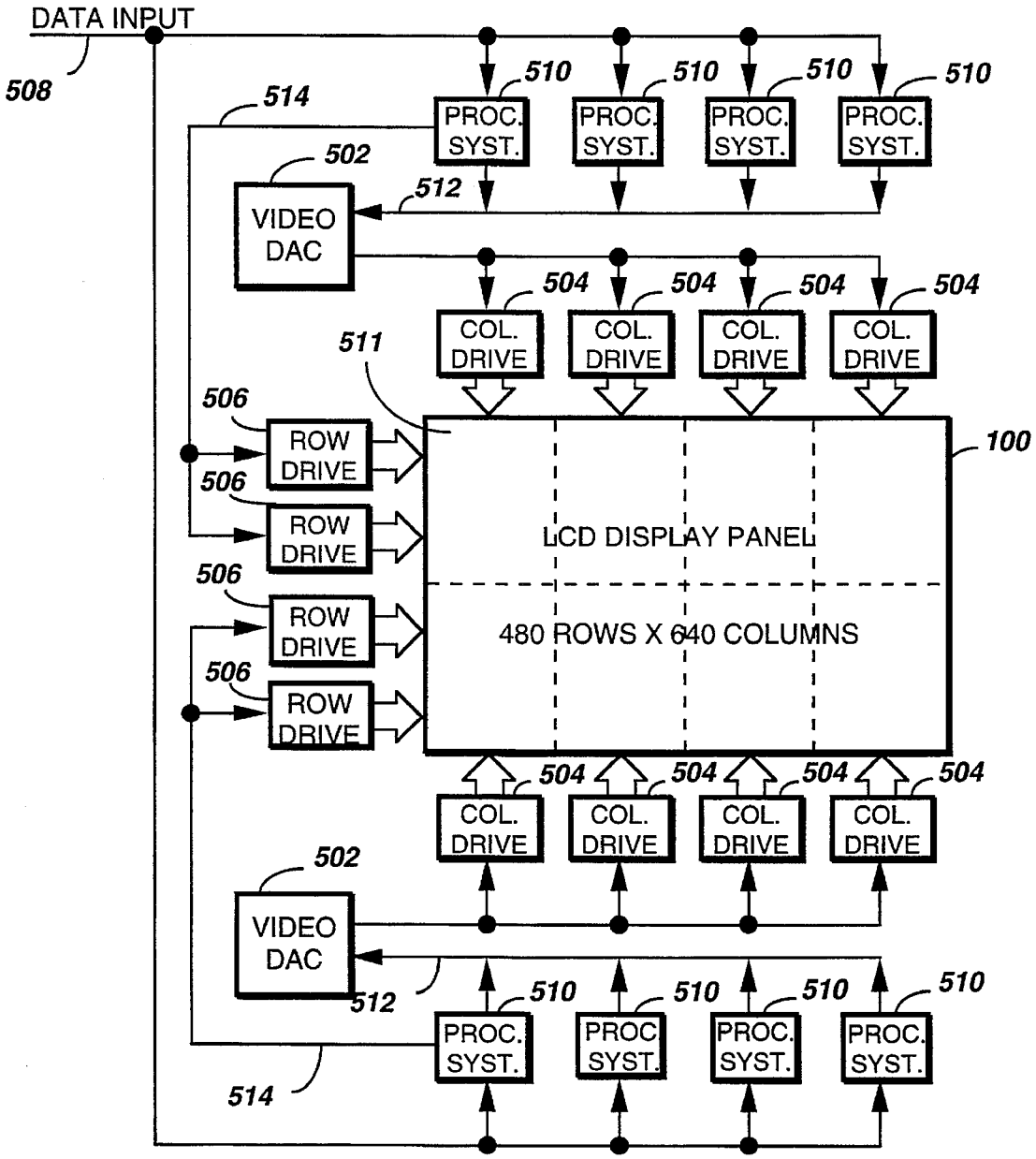
FIG. 5 is an electrical block diagram of a display system in accordance with the preferred embodiment of the present invention.

Referring to FIG. 5, an electrical block diagram of a display system 500 in accordance with the preferred embodiment of the present invention comprises a plurality of processing systems 510 coupled to a data input line 508, preferably eight bits wide, for receiving frames of data to be displayed. To reduce calculation requirements for each of the processing systems 510 the LCD 100 has been partitioned into eight areas 511 each serviced by one of the processing systems 510, and each containing one-hundred-sixty column electrodes 104 and two-hundred-forty row electrodes 106.

The processing systems 510 are coupled by column output lines 512, preferably eight bits wide, to video digital-to-analog converters (DACs) 502, such as the model CXD1178Q DAC manufactured by Sony Corporation, for converting the digital output signals of the processing systems 510 into corresponding analog column drive signals. The DACs 502 are coupled to column drive elements 504 of an analog type, such as the model SED1779DOA driver manufactured by Seiko Epson Corporation, for driving the column electrodes 104 of the LCD 100 with the analog column drive signals. Two of the processing systems 510 are also coupled by row output lines 514 to row drive elements 506 of a digital type, such as the model SED1704 driver also manufactured by Seiko Epson Corporation, for driving the row electrodes 106 of the upper and lower partitions of the LCD 100 with a predetermined set of Walsh waves. It will be appreciated that other similar components can be used as well for the DACs 502, the column drive elements 504, and the row drive elements 506.

The column and row drive elements 504, 506 receive and store a batch of drive level information intended for each of the column and row electrodes 104, 106 for the duration of the time slot t (FIG. 4). The column and row drive elements 504, 506 then substantially simultaneously apply and maintain the drive levels for each of the column and row electrodes 104, 106 in accordance with the received drive level information until a next batch, e.g., a batch corresponding to the next time slot t, is received by the column and row drive elements 504, 506. In this manner the transitions of the drive signals for all the column and row electrodes 104, 106 occur substantially in synchronism with one another.

Figure 6:
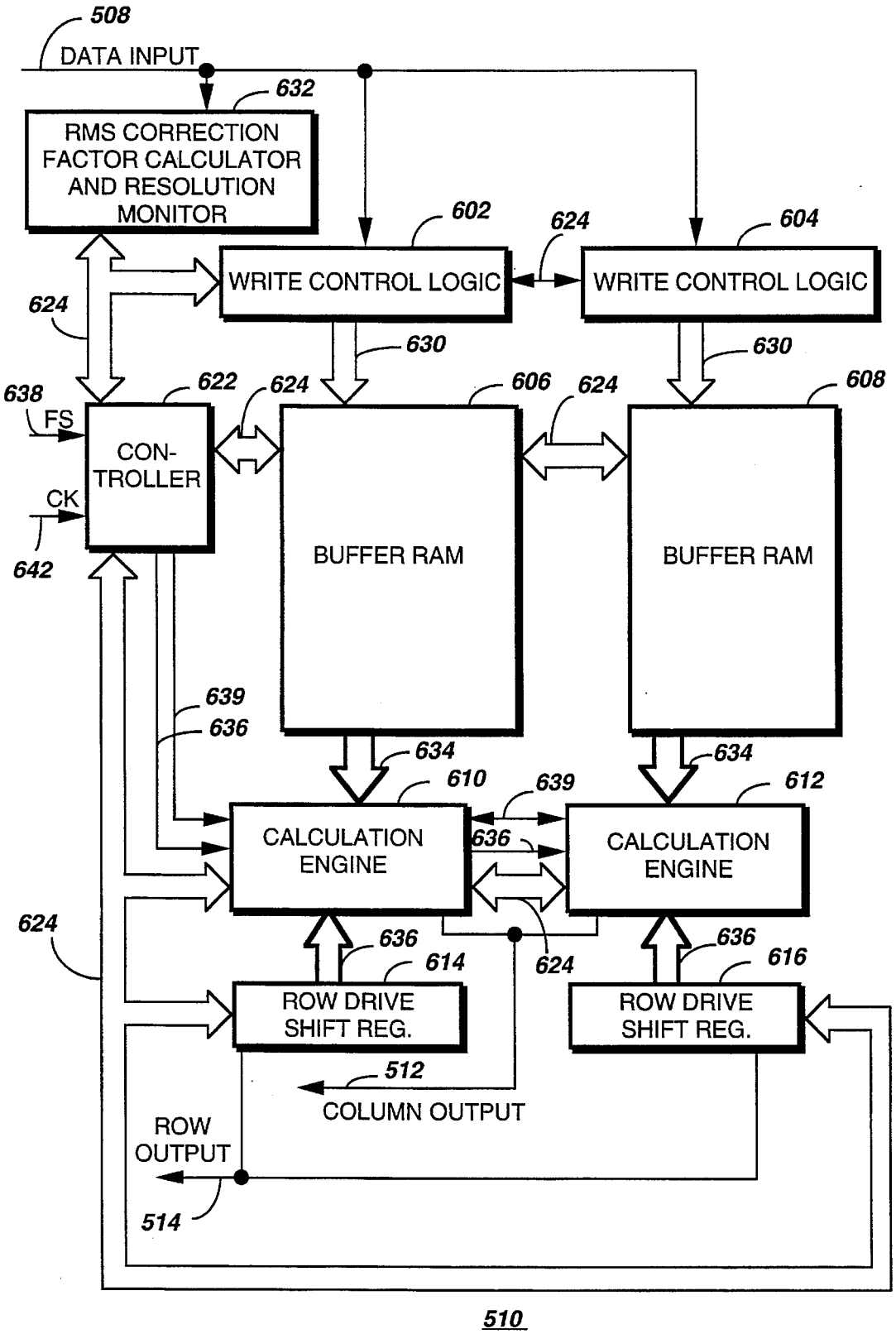
FIG. 6 is an electrical block diagram of a processing system of the display system in accordance with the preferred embodiment of the present invention.

Referring to FIG. 6, an electrical block diagram of one of the processing systems 510 of the display system in accordance with the preferred embodiment of the present invention comprises the data input line 508 coupled to first and second write control logic elements 602, 604. The first and second write control logic elements 602, 604 comprise a conventional serial-to-parallel converter, a conventional counter, and conventional random access memory (RAM) control logic. The function of the first and second write control logic elements 602, 604 is to receive data comprising pixel states from the data input line 508, to convert the received data into data bytes, and to send the data bytes over the parallel busses 630 to the first and second buffer RAMs 606, 608 for storage. The data bytes within the first and second buffer RAMs 606, 608 are organized by the first and second write control logic elements 602, 604 into blocks, each block corresponding to substantially all the pixels 108 controlled by a single group of column electrodes 104, the group size determined in accordance with the present invention, and the column electrodes 104 falling within the area 511 serviced by the processing system 510.

A controller 622 is coupled by a control bus 624 to the first and second write control logic elements 602, 604 and to the first and second buffer RAMs 606, 608 for controlling their operation. The controller 622 is further coupled by the control bus 624, by a virtual value line 636, and by an engine portion enable line 639 to first and second calculation engines 610, 612 for controlling their operation. The controller 622 is further coupled by the control bus 624 to first and second row drive shift registers 614, 616 for controlling their operation as well. The controller 622 is also coupled by the control bus 624 to an rms correction factor calculator and resolution monitor 632 for controlling the rms correction factor calculator and resolution monitor 632 and for receiving and storing correction factors and resolution values determined by and sent from the rms correction factor calculator and resolution monitor 632. The rms correction factor calculator and resolution monitor 632 is also coupled to the data input line 508 for monitoring the frames of data to determine correction factors and data resolution therefrom, as explained herein below in reference to FIG. 7. A frame sync line 638 and a clock line 642 also are coupled to the controller 622 to provide synchronization with the input data for the controller 622.

The controller 622 coordinates the operation of the first and second write control logic elements 602, 604 such that the first and second write control logic elements 602, 604 alternate in processing the frames of data received from the data input line 508. That is, the first write control logic element 602 receives a frame of data and transmits the frame of data to the first buffer RAM 606. Then the second write control logic element 604 receives a next frame of data and transmits that frame of data to the second buffer RAM 608. Then the first write control logic element 602 receives a next frame of data and transmits that frame of data to the first buffer RAM 606, and so on, receiving and transmitting alternate frames of data.

The first and second buffer RAMs 606, 608 are coupled by parallel data busses 634 to first and second calculation engines 610, 612 for calculating values for driving the column electrodes 104 for each Walsh wave time slot t. The parallel data busses 634 are sufficiently wide to transmit simultaneously pixel values for substantially all the pixels 108 controlled by a single group of column electrodes 104 and falling within the area 511 of the LCD 100 serviced by the processing system 510. For example, in the processor 510 servicing two-hundred-forty rows and having eight-bit pixel values, the first and second parallel data busses 634 each must have one-thousand-nine-hundred-twenty (1920) parallel paths. The structure and operation of the first and second calculation engines 610, 612 are described in greater detail herein below.

The first and second calculation engines 610, 612 are also coupled to first and second row drive shift registers 614, 616 by parallel transfer busses 636 for transferring the Walsh function values to the first and second calculation engines 610, 612. The parallel transfer busses 636 must be sufficiently wide to transfer a one-bit Walsh function value for each row serviced by the processing system 510. For example, in the processor 510 servicing two-hundred-forty rows, the parallel transfer busses 636 must have two-hundred-forty parallel paths. It will be appreciated that while Walsh functions are preferred, other orthonormal functions may be used as well by the first and second calculation engines 610, 612 to perform the calculations.

The function of the first and second row drive shift registers 614, 616 is to receive from the controller 622 the Walsh function values corresponding to the rows serviced by the processor 510 for each time slot t. Having received the Walsh function values for the time slot t, the first and second row drive shift registers 614, 616 then transfer the received Walsh function values for the time slot t to the first and second calculation engines 610, 612 for use in calculating column drive signals for the time slot, as described herein below. The first and second row drive shift registers 614, 616 also drive the row output line 514 at a rate controlled by the controller 622 in accordance with the present invention with the Walsh function values corresponding to the rows serviced by the processor 510 for each time slot t.

The controller 622 coordinates and controls the operation of the first and second calculation engines 610, 612 and the first and second row drive shift registers 614, 616 such that the first and second calculation engines 610, 612 and the first and second row drive shift registers 614, 616 alternate in processing the frames of data read from the first and second buffer RAMs 606, 608. That is, the first calculation engine 610 and the first row drive shift register 614 process a frame of data and drive the column output line 512 and the row output line 514 in accordance with the values calculated for the frame of data. Then the second calculation engine 612 and the second row drive shift register 616 process the next frame of data and drive the column output line 512 and the row output line 514 in accordance with the values calculated for that next frame of data. Then the first calculation engine 610 and the first row drive shift register 614 process the next frame of data and drive the column output line 512 and the row output line 514 in accordance with the values calculated for that frame of data, and so on, processing alternate frames of data.

The reason for the alternating processing taking place within the processing system 510 is so that while the first buffer RAM 606 is receiving a new frame of data, the second buffer RAM 608 can be delivering a previously received frame of data to the second calculation engine 612 for output, and vice versa. It will be appreciated that because the first and second calculation engines 610, 612 and the first and second row drive shift registers 614, 616 are each active only during alternate frames of data, one of the first and second calculation engines 610, 612 and one of the first and second row drive shift registers 614, 616 could be eliminated. This would of course require the addition of control and data routing circuitry to allow a single calculation engine to receive data alternately from both the first and second buffer RAMs 606, 608. For similar reasons, the first and second write control logic elements 602, 604 could be combined into a single write control logic element. For integrated circuit fabrication reasons, however, the preferred architecture is the fully duplicated architecture depicted in FIG. 6.

Figure 7:
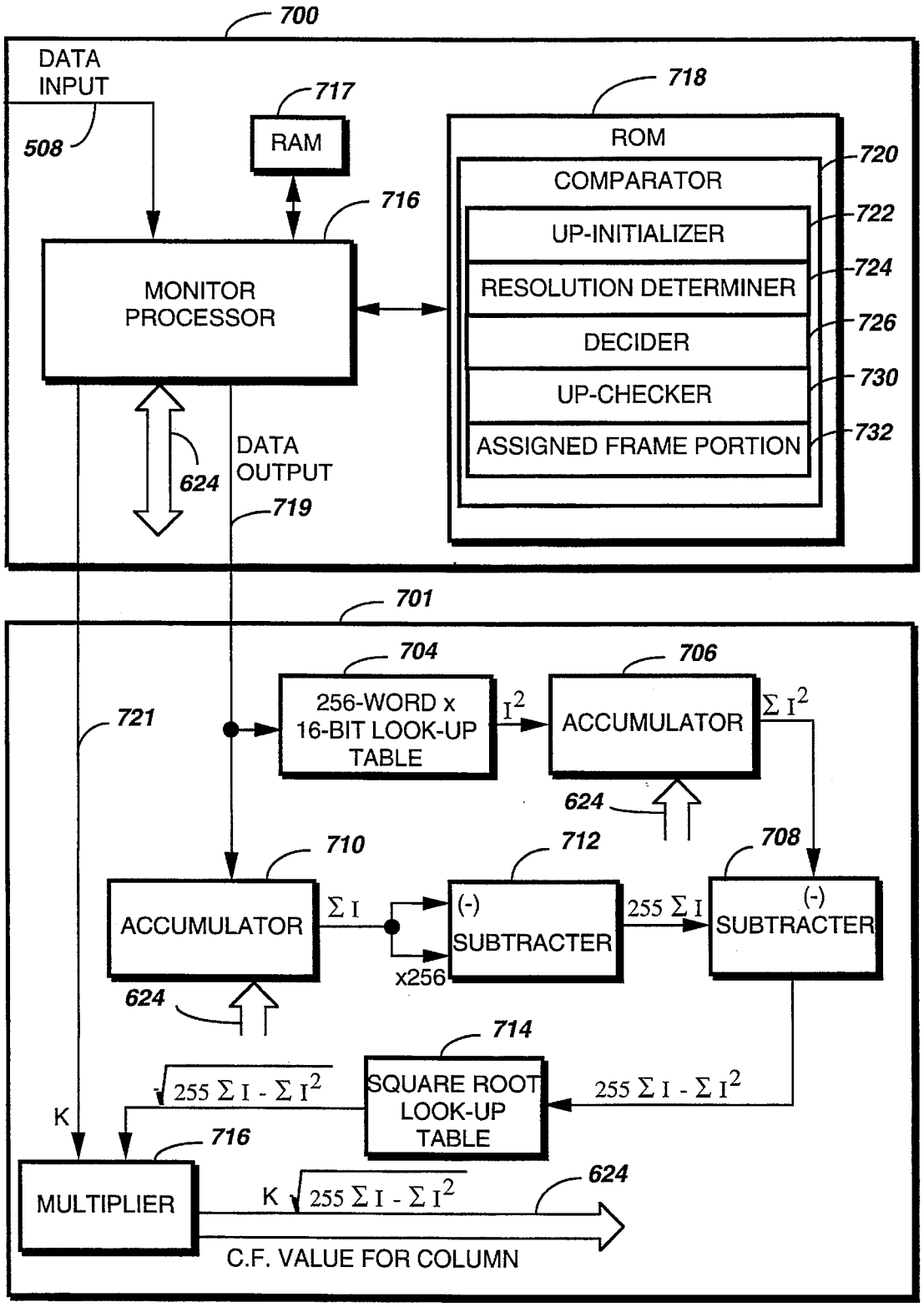
FIG. 7 is an electrical block diagram of an rms correction factor calculator and resolution monitor of the processing system in accordance with the preferred embodiment of the present invention.

Referring to FIG. 7, an electrical block diagram of the rms correction factor calculator and resolution monitor 632 of the processing system 510 in accordance with the preferred embodiment of the present invention comprises the data input line 508, for receiving input and control signals, and the control bus 624, for controlling an rms correction factor calculator 701 and a resolution monitor 700. For a display using +1 to represent a fully "off" pixel and −1 to represent a fully "on" pixel, and using Walsh functions having values of only +1 and −1, the correction factor for each column of the display is $$\frac{1}{\sqrt{N}}\sqrt{N-\sum_{i=1}^{N} I_i^2}\ , \tag{1}$$

where N is the number of rows actually driven, and $I_i$ is the pixel value for the pixel in the ith row of the column.

Adjusting for eight-bit pixel values having a range of 0–255, and assuming there are two-hundred-forty rows driven, equation (1) becomes $$\frac{1}{\sqrt{240}}\sqrt{240-\sum_{i=1}^{240}\left(\frac{I_i-127.5}{127.5}\right)^2}\ , \tag{2}$$

which simplifies to $$\frac{1}{127.5\sqrt{240}}\sqrt{255\sum_{i=1}^{240} I_i-\sum_{i=1}^{240} I_i^2}\ , \tag{3}$$

which simplifies further to $$\frac{\sqrt{255\sum_{i=1}^{240} I_i-\sum_{i=1}^{240} I_i^2}}{1975}\ . \tag{4}$$

If, alternatively, the number of rows is reduced to one-hundred-twenty, then equation (3) becomes $$\frac{1}{127.5\sqrt{120}}\sqrt{255\sum_{i=1}^{120} I_i-\sum_{i=1}^{120} I_i^2}\ , \tag{5}$$

which simplifies further to $$\frac{\sqrt{255\sum_{i=1}^{120} I_i-\sum_{i=1}^{120} I_i^2}}{1397}\ . \tag{6}$$

It is the function of the rms correction factor calculator 701 to calculate this correction factor, for each group of columns driven, from the data arriving over the data output line 719 from the resolution monitor 700. The calculated rms correction factors, each corresponding to a group of columns driven, are transferred to the controller 622 over the control bus 624 for temporary storage and subsequent retransmission over the control bus 624 to the calculation engine 610, 612. Within the calculation engine 610, 612 the rms correction factor is combined with a summation of products of pixel and row values in accordance with conventional active addressing techniques, as described herein below in reference to FIG. 8. The purpose of the rms correction factors is to eliminate a non-linear term that would otherwise enter into each column value calculation, as can be proven mathematically by one of ordinary skill in the art of conventional active addressed displays. In accordance with the preferred embodiment of the present invention, the data on the data output line 719 can be either a copy of the data on the data input line 508 or a predetermined subset thereof, as will be explained herein below.

The rms correction factor calculator 701 comprises a first accumulator 710 coupled to the data output line 719 for summing the pixel values received. The output of the first accumulator 710 is coupled to both inputs of a first subtracter 712, wherein the minuend input data is first shifted eight bits to the left to multiply the minuend input data by two-hundred-fifty-six, thus producing an output value of 255 ΣI.

The data output line 719 is also coupled to the input of a first look-up table element 704 for determining the square of the pixel value. The output of the first look-up table element 704 is coupled to the input of a second accumulator 706 for summing the squares of the pixel values. The output of the second accumulator 706 is coupled to the subtrahend input of a second subtracter 708, to which the output of the first subtracter 712 is coupled at the minuend input for obtaining the difference $255\Sigma I-\Sigma I^2$. The output of the second subtracter 708 is coupled to a second look-up table element 714 for determining the square root value $\sqrt{255\Sigma I-\Sigma I^2}$.

The output of the second look-up table element 714 is coupled to an input of a multiplier element 716. The other input of the multiplier element 716 is programmed from the resolution monitor 700 by a program line 721 for one of two constant values K. The value of K provides for the division factor of 1975 from equation (4) or the factor of 1397 from equation (6), the value dependent upon the resolution determined by the resolution monitor 700 as described below, as well as any other drive level adjustments that may be required for the LCD 100. The output of the multiplier element 716 is coupled by the control bus 624 to the controller 622 for storing the calculated correction factor K $\sqrt{255\Sigma I-\Sigma I^2}$. It will be appreciated that an arithmetic logic unit or a microcomputer can be substituted for some or all of the first and second look-up table elements 704, 714 and the multiplier element 716. It will be further appreciated that a microcomputer can also replace all the elements of the rms correction factor calculator 701.

The resolution monitor 700 comprises a monitor processor 716 coupled to a random access memory (RAM) 717 for temporary storage of operating data and a read-only memory (ROM) 718 comprising a comparator 720 for comparing adjacent monitored pixel values to determine resolution of the data in accordance with the preferred embodiment of the present invention. The monitor processor 716 is also coupled to the data input line 508 for receiving the frames of data comprising the pixel values. Under the control of the controller 622 by the control bus 624, the monitor processor can output the received pixel values unaltered to the data output line 719. Alternatively, the monitor processor can output to the data output line 719 every second pixel value received, thus halving the calculation rate required of the rms correction factor calculator 701. The reduced calculation rate, when applied in accordance with the present invention, advantageously reduces the power consumption of the rms correction factor calculator 701, contributing to longer battery life in a battery operated device incorporating the display system 500.

The comparator 720 comprises an up-initializer 722, a resolution determiner 724, a decider 726, an up-checker 730, and an assigned frame portion identifier 732. The up-initializer 722 is used to form contiguous groups of pixel values, each group containing a trial number of pixel values corresponding to adjacent pixels 108, the trial number starting at a predetermined initial value, e.g., two pixels per group. The resolution determiner 724 then examines the pixel values in each group and determines that the resolution, measured in pixels, is at least the trial number in response to finding that all the pixel values within each group are equal to one another in substantially all the groups. Alternatively, the decider 726 is used for determining that the resolution is less than the trial number in response to finding that all the pixel values within each group are equal to one another in less than all the groups, i.e., at least one group contains differing pixel values.

The up-checker 730 increases each group in size to form fewer groups each containing a larger trial number of pixel values in response to finding that all the pixel values within each group are equal to one another in substantially all the groups. The up-checker 730 also repeats the resolution determination while increasing the trial number up to a predetermined maximum value for the system, or until the trial number is an amount such that all the pixel values within each group are equal to one another in less than substantially all the groups. The assigned frame portion identifier 732 informs the monitor processor which area 511 of the LCD 100 the rms correction factor calculator and resolution monitor 632 is responsible for processing.

Figure 8:
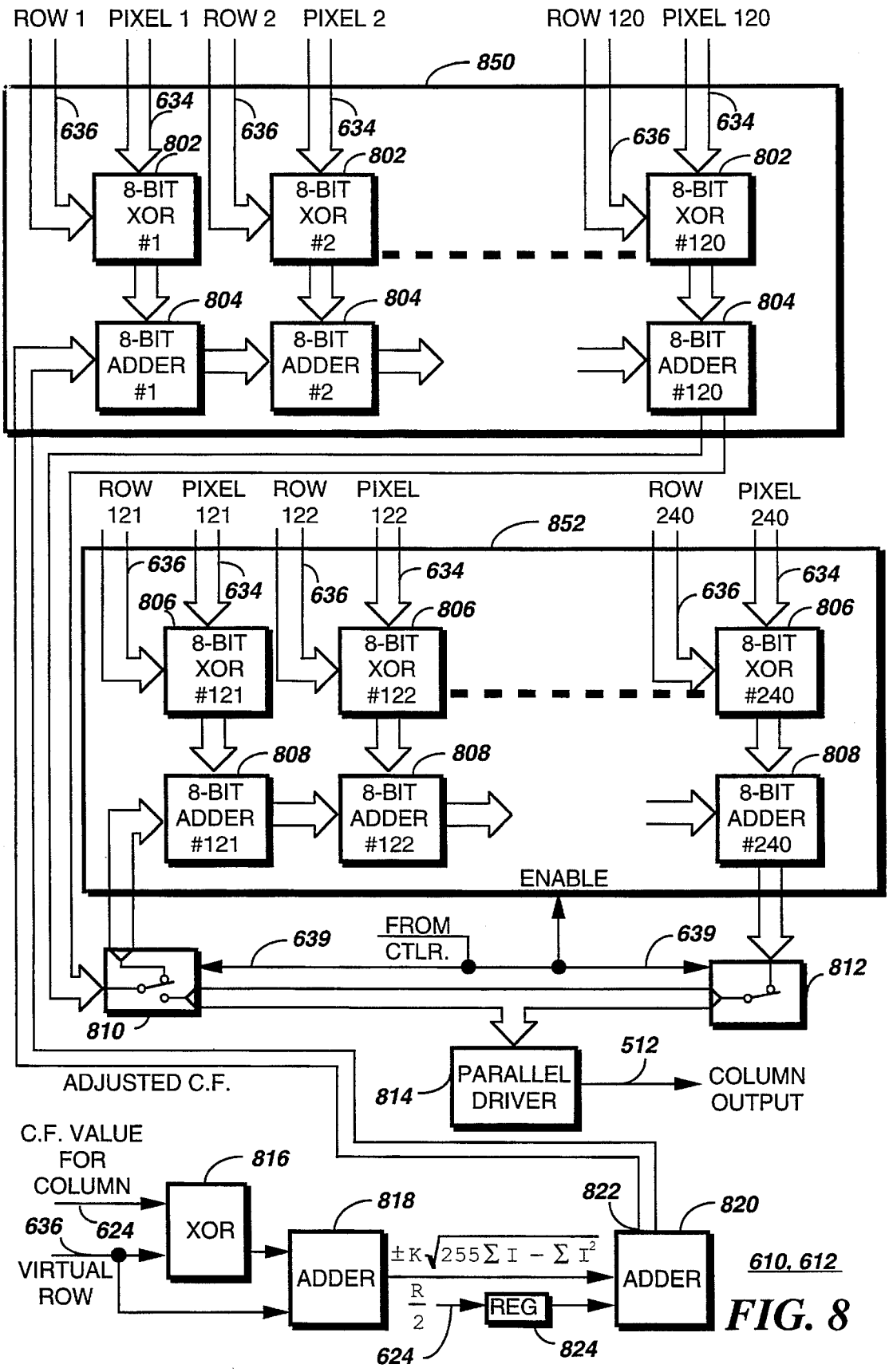
FIG. 8 is an electrical block diagram of a calculation engine of the processing system in accordance with the preferred embodiment of the present invention.

Referring to FIG. 8, an electrical block diagram of one of the calculation engines 610, 612 of the processing system 510 in accordance with the preferred embodiment of the present invention comprises a plurality of 8-bit exclusive-OR (XOR) elements 802, 806. The XOR elements 802, 806 are coupled to the parallel data busses 634 for receiving pixel values from one of the buffer RAMs 606, 608, under the control of the controller 622. The XOR elements 802, 806 are also coupled to the parallel transfer busses 636 for receiving Walsh function row values from one of the row drive shift registers 614, 616, also under the control of the controller 622. The function of the XOR elements 802, 806 is to complement the bits of the pixel values whenever the corresponding row value is a logic ONE, and to leave the pixel value unchanged whenever the corresponding row value is a logic ZERO. A value of ONE must be added to each complemented pixel value (as explained herein below) in order to correctly subtract the pixel value from a sum being accumulated by the calculation engine 610, 612.

The outputs of the XOR elements 802, 806 are coupled to adder elements 804, 808, which are coupled to each other, for generating a sum of the pixel values that have not been complemented by the XOR elements 802, 806, and for subtracting from the sum the pixel values that have been complemented. The input of the first adder element 804 is coupled to the output 822 of a correction factor adjusting system, comprising elements 816, 818, 820, 824 for adjusting the sign of the correction factor in accordance with the Walsh function value for the time slot for the virtual row element corresponding to the column being calculated, and for adding the requisite value of ONE to each of the complemented pixel values.

For simplicity, the adder elements 804, 808 and the XOR elements 802, 806 have been grouped into two switchable partitions 850, 852 each having one-hundred-twenty XOR-adder stages for adapting operation of the calculation engine 610, 612 to two levels of resolution as described herein below. One of ordinary skill in the art will recognize that additional switchable partitions can be provided in accordance with the preferred embodiment of the present invention to adapt the calculation engine 610, 612 to additional levels of resolution. For example, switchable partitions containing thirty, an additional thirty, an additional sixty, and an additional one-hundred-twenty XOR and adder elements would be required to adapt to four levels of resolution, i.e., one, two, four, and eight pixels of resolution.

The output of the adder element 804 serving row one-hundred-twenty is coupled to first electronic switch 810, which, when enabled by the engine portion enable line 639, couples the adder element 804 serving row one-hundred-twenty to the input of the adder element 808 serving row one-hundred-twenty-one. Alternatively, when not enabled by the engine portion enable line 639, the first electronic switch 810 couples output of the adder element 804 serving row one-hundred-twenty to a parallel driver 814, preferably eight bits wide, for driving the column output line 512. A second electronic switch 812, when enabled by the engine portion enable line 639, couples the output of the adder element 808 serving the two-hundred-fortieth row to the parallel driver 814. The engine portion enable line 639 is also coupled to all the XOR elements 806 and all the adder elements 808 for enabling and disabling the XOR elements 806 and the adder elements 808 in response to the state of the engine portion enable line 639.

When the calculation engines 610, 612 are switchably divided in the manner described above, the calculation engines 610, 612 are controllable to operate in accordance with received data resolutions of both 1×1 pixel, and 2×2 pixels. At the latter less-detailed resolution the calculation rate required in the calculation engines 610, 612 is reduced, advantageously resulting in lower power consumption. By halving the shift rate of the row drive shift registers 614, 616 as further described herein below, a reduced number of calculated column drive signals expands to fill the entire area 511 of the LCD 100 serviced by the calculation engines 610, 612, thus producing an image resolution corresponding to the resolution of the received data.

The correction factor adjusting system comprises an XOR element 816 coupled to the controller 622 by the control bus 624 for receiving the correction factor for the group of columns, as stored previously in the RAM 906 by the controller 622, and for receiving over the virtual value line 636 the virtual row value of the Walsh function for the virtual row element corresponding to the column being calculated. The output of the XOR element 816 is coupled to an input of an adder element 818. The other input of the adder element 818 is coupled to the virtual value line 636. The function of the XOR element 816 and the adder element 818 so coupled is to cause the sign of the correction factor value to be negative whenever the virtual row value is a logic ONE, and positive whenever the virtual row value is a logic ZERO. The output of the adder 818 is coupled to an input of an adder 820. The other input of the adder 820 is programmed by the controller 622 over the control bus 624 for a row correction value equal to one-half the number of groups of rows being processed for all time slots except the first, for which the adder 820 is programmed by the controller 622 for a row correction value equal to the number of groups of rows being processed. The programmed value is held in an addressable register 824.

The reason for adding the row correction values is to accomplish the requisite addition of ONE to each complemented pixel value. For example, the predetermined Walsh factors for two-hundred-forty real groups of rows have exactly one-hundred-twenty logic ONEs in every time slot except the first time slot, which has two-hundred-forty logic ONEs. This means that for every time slot except the first there will be one-hundred-twenty pixel values complemented by the XOR elements 802, 806 of the calculation engine 610, 612. For the first time slot, all two-hundred-forty pixel values will be complemented. As indicated herein above, a value of ONE must be added to each of the complemented pixel values in order to correctly subtract the pixel values from the sum. The adder 820 and the addressable register 824 accomplish this.

Figure 9:
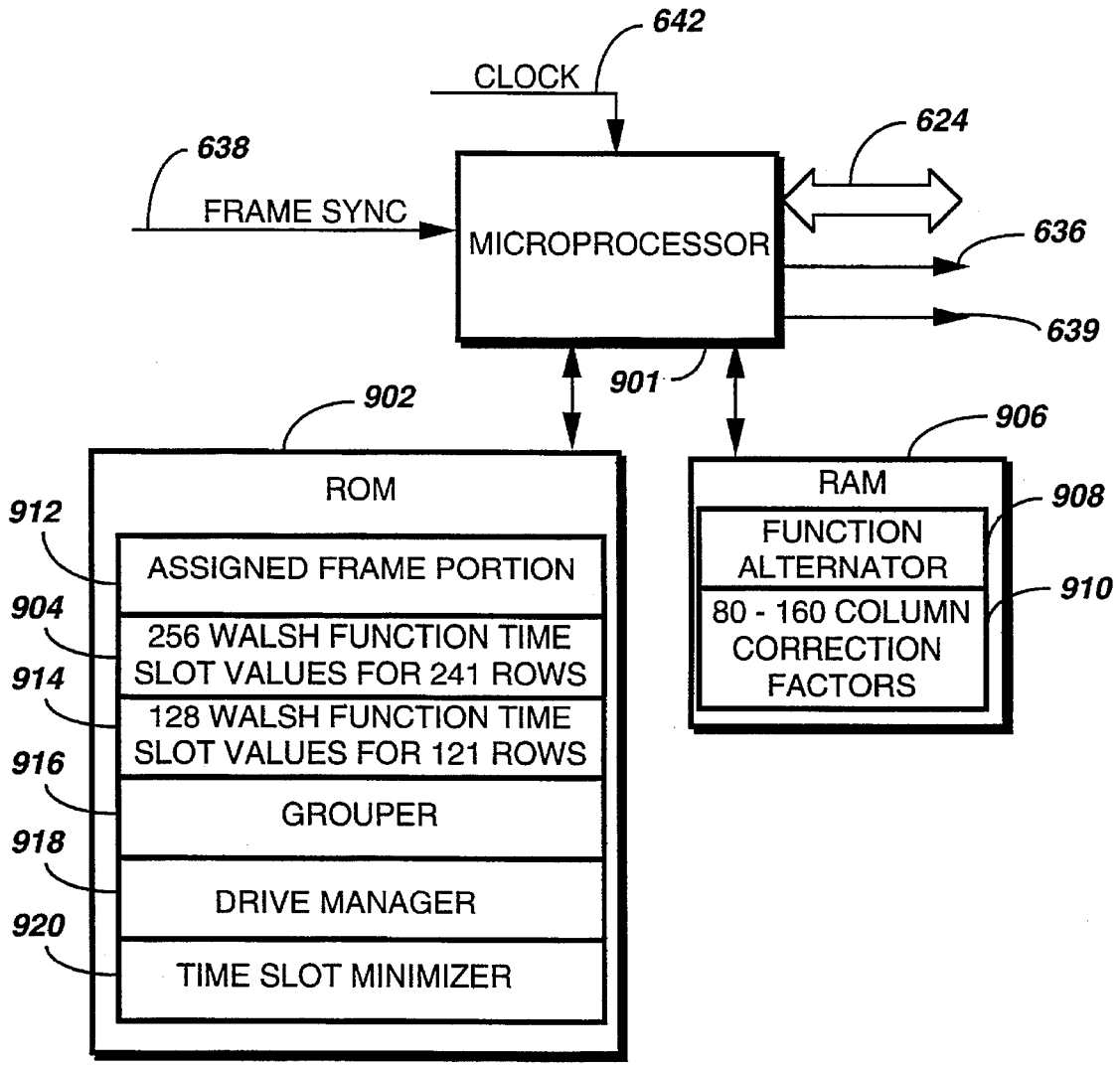
FIG. 9 is an electrical block diagram of a controller of the processing system in accordance with the preferred embodiment of the present invention.

Referring to FIG. 9, an electrical block diagram of the controller 622 of the processing system 510 in accordance with the preferred embodiment of the present invention comprises a microprocessor 901 coupled to a read-only memory (ROM) 902 containing operating system firmware elements. The ROM 902 has been pre-programmed with an assigned frame portion value 912 indicating the portion of the frame of data, i.e., the area 511 of the LCD 100, that the processing system 510 comprising the controller 622 is assigned to process. The ROM 902 further contains a first set 904 of two-hundred-fifty-six Walsh function time slot values for driving each of two-hundred-forty groups of row electrodes 106, plus one virtual row. The ROM 902 also contains a second set 914 of one-hundred-twenty-eight Walsh function time slot values for driving each of one-hundred-twenty groups of row electrodes 106, plus one virtual row.

The ROM 902 also includes a grouper element 916 for grouping adjacent ones of the plurality of electrodes 104, 106 in accordance with the resolution of the received data, as determined by the resolution monitor 700. Also in the ROM 902 is a drive manager 918 for managing the driving of the grouped adjacent ones of the plurality of electrodes 104, 106 from a plurality of common drive signals. The ROM 902 preferably further contains a time slot minimizer 920 for selecting a minimum possible quantity of active addressing time slots in accordance with the resolution of the received data, the number of time slots being equal to two-hundred-fifty-six for a resolution of 2×2 pixels, and one-hundred-twenty-eight for a resolution of 1×1 pixel.

It will be appreciated that, alternatively, horizontal granularity can be increased, e.g., to two pixels, without increasing vertical granularity. For example, with slight modifications to the firmware of the controller 622, a resolution of 2×1 pixels can be achieved by halving the number of column drive calculations, while maintaining the number of timeslots at the value for full one-pixel resolution. This would allow pairs of adjacent columns to be driven by a common column drive signal, while individual rows continue to be driven by individual row drive signals.

The microprocessor 901 is also coupled to a random access memory (RAM) 906, having a location for storing a function alternator 908 for alternating the functions of elements of the processing system 510, as described herein above. The RAM 906 further comprises a location for storing a quantity of eighty to one-hundred-sixty column correction factors 910 received from the rms correction factor calculator 701 over the control bus 624, the quantity determined in accordance with the resolution of the received data.

The microprocessor 901 is further coupled to the frame sync line 638 and to the clock line 642 for receiving frame sync and clock signals, respectively, from a source of the frames of data, e.g., a processor of a personal computer. The microprocessor 901 is coupled to the processing system 510 by the control bus 624, and the virtual value line 636 for controlling the processing system 510.

Figure 10:
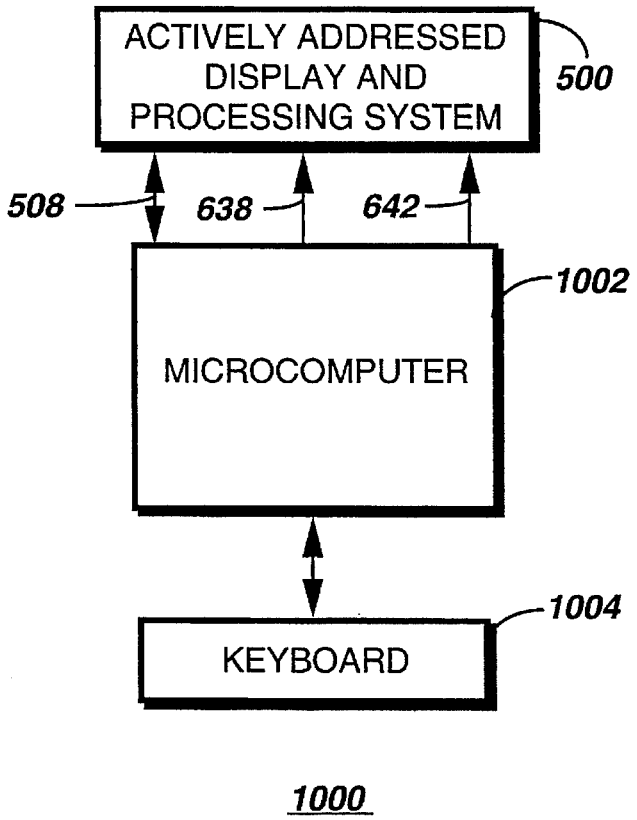
FIG. 10 is an electrical block diagram of a personal computer in accordance with the preferred embodiment of the present invention.
Figure 11:
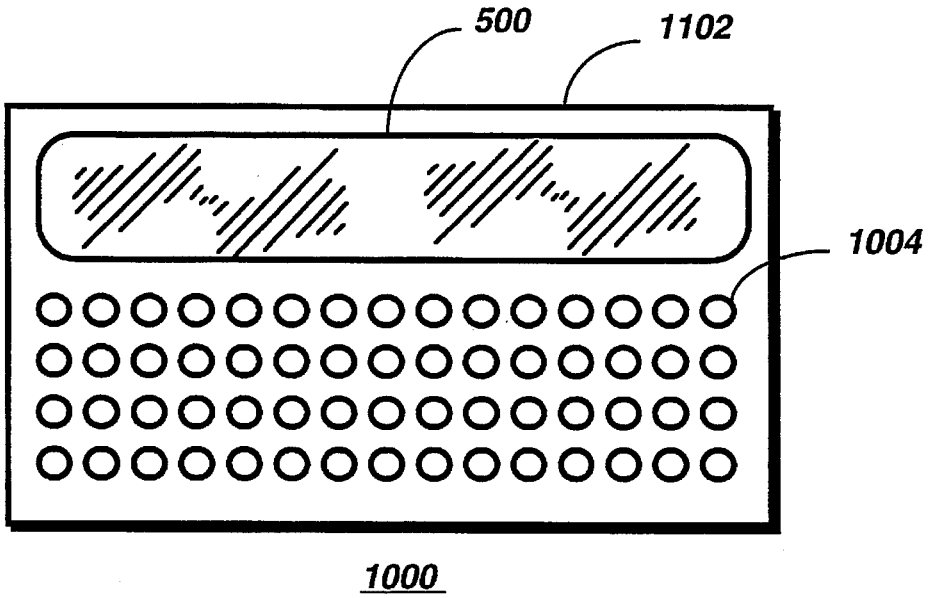
FIG. 11 is a front orthographic view of the personal computer in accordance with the preferred embodiment of the present invention.

Referring to FIG. 10, an electrical block diagram of a personal computer 1000 in accordance with the preferred embodiment of the present invention comprises the display system 500 coupled to a microcomputer 1002 by the data input line 508 for receiving frames of data from the microcomputer 1002. The display system 500 is further coupled to the microcomputer 1002 by the frame sync line 638 and the clock line 642 for receiving frame sync and clock, from the microcomputer 1002. The microcomputer 1002 is coupled to a keyboard 1004 for receiving input from a user. Referring to FIG. 11, a front orthographic view of the personal computer 1000 in accordance with the preferred embodiment of the present invention depicts the display system 500 supported and protected by a housing 1102. The keyboard 1004 is also depicted. Personal computers, such as the personal computer 1000, often are constructed as portable, battery-powered units. The display system 500 is particularly advantageous in such battery-powered units, because the reduced calculation rate of the processing system 510 of the display system 500 compared to conventional processing systems for actively addressed displays greatly reduces the power consumption, thus extending the battery life.

For the purpose of discussing the operation of the display system 500, it is necessary to define some terms. The term "first processor" as used herein below refers to a first portion of the plurality of processing systems 510. The first portion collectively comprises the first write control logic elements 602, the first buffer RAMs 606, the first calculation engines 610, and the first row drive shift registers 614, of the plurality of processing systems 510. The term "second processor" as used herein below refers to a second portion of the plurality of processing systems 510. The second portion collectively comprises the second write control logic elements 604, the second buffer RAMs 608, the second calculation engines 612, and the second row drive shift registers 616, of the plurality of processing systems 510. The rms correction factor calculators 701, the resolution monitors 700, and the controllers 622 collectively are common to both the first and second processors. In addition, the terms "column" and "row" as used in reference to FIGS. 12–14 mean a single column and a single row when the resolution of the received data is one pixel. For a resolution of two pixels and higher the terms "column" and "row" refer to groups of columns and groups of rows, the group size being equal to the resolution, and all electrodes common to a each group being driven by a common electrode drive signal.

System operation is such that when frame sync is received, each controller 622 of the plurality of processing systems 510 determines from the assigned frame portion value 912 which portion of the frame of data the processing system 510 that comprises the controller 622 is assigned to process. The controller 622 then delays the start of processing by the corresponding processing system 510 until the frame of data reaches the assigned portion. The controller 622 also accesses the function alternator 908 to control the alternation of processing functions between the first and second processor.

Figure 12:
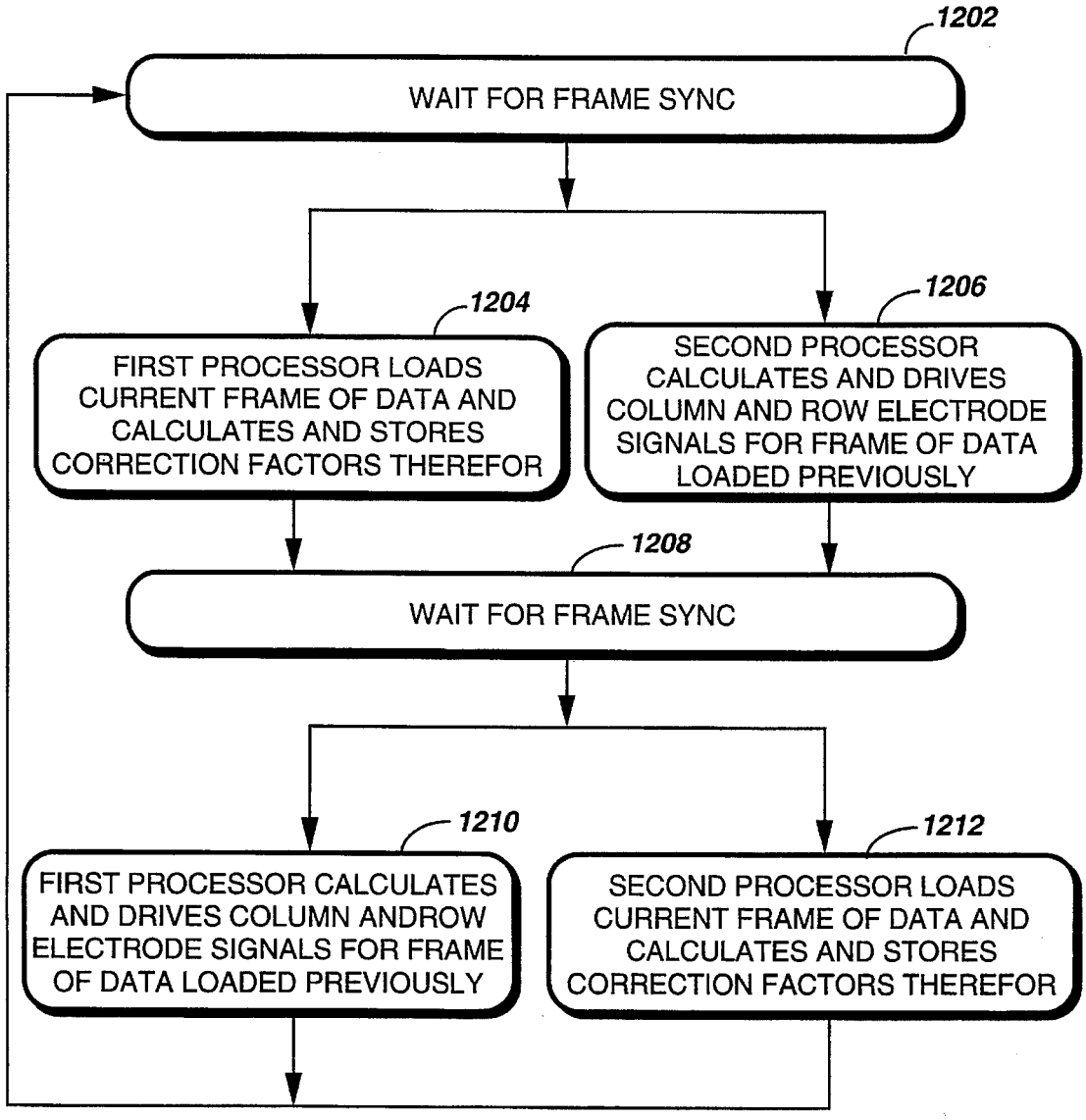
FIG. 12 is a flow chart depicting the operation of the display system in accordance with the preferred embodiment of the present invention.

Referring to FIG. 12, a flow chart depicting the operation of the display system 500 in accordance with the preferred embodiment of the present invention begins with the controllers 622 of the first and second processors waiting 1202 for frame sync. When frame sync arrives, the first processor loads 1204 the current frame of data while the rms correction factor calculators 632 calculate the column correction factors for the portion of the frame of data assigned to the respective processing systems 510 corresponding to each of the rms correction factor calculators 632. This is followed by the storing of the calculated column correction factors by the controllers 622 in the RAM 906 at the location for storing column correction factors 910.

Meanwhile, the second processor concurrently calculates 1206 in the second calculation engines 612 the column signals from a frame of data stored previously in the second buffer RAMs 608, using Walsh function values supplied to the second row drive shift registers 616 by the controllers 622. The second processor then drives the column output line 512 and the row output line 514 with the calculated column signals and the Walsh function values, respectively. The controllers 622 coordinate the processing systems 510 to calculate and drive the column and row output lines 512, 514 at the correct times corresponding to their respective portions of the frames of data.

Next, the first and second processors again wait 1208 for frame sync. When frame sync arrives, the first processor calculates 1210 in the first calculation engines 610 the column signals from the frame of data stored previously in the first buffer RAMs 606, using Walsh function values supplied to the first row drive shift registers 614 by the controllers 622. The first processor then drives the column output line 512 and the row output line 514 with the calculated column signals and the Walsh function values, respectively. The controllers 622 coordinate the processing systems 510 to calculate and drive the column and row output lines 512, 514 at the correct times corresponding to their respective portions of the frames of data.

Meanwhile, the second processor concurrently loads 1212 the current frame of data while the rms correction factor calculators 632 calculate the column correction factors for the portion of the frame of data assigned to the respective processing systems 510 corresponding to each of the rms correction factor calculators 632. This is followed by the storing of the calculated column correction factors by the controllers 622 in the RAM 906 at the location for storing column correction factors 910. The flow then returns to step 1202, and the process repeats.

By alternately loading the first and second buffer RAMs 606, 608 with a full frame of data before processing the frame of data in the processing systems 510, the display system 500 advantageously allows the data to be processed in parallel, thereby significantly reducing the calculation rate, e.g., by a factor of two-hundred-forty, compared to conventional actively addressed display systems. By further partitioning the LCD 100 into the eight areas 511 having half as many rows as the full LCD 100 for processing as described herein above, the processing load is reduced by an additional factor of sixteen. Thus, the processing systems 510 are able to operate at a clock rate of approximately two and one-half MHz, as compared to the forty MHz clock rate required without the partitioning. The reduction in the calculation rate significantly reduces the power consumption of the display system 500, thus enabling substantially improved battery life in a portable electronic device that includes the display system 500.

Referring to FIG. 13, a flow chart depicting the operation of the rms correction factor calculator 701 in accordance with the preferred embodiment of the present invention begins with the controller 622 waiting 1302 for its assigned time after frame sync corresponding to its assigned start-processing time for the area 511 of the LCD 100 assigned to the controller 622. When the start-processing time arrives, the first and second accumulator elements 710, 706 are initialized 1304 to zero by the controller 622, and the monitor processor 716 begins sending pixel values to the rms correction factor calculator 701. Next, the first look-up table element 704 squares 1310 the pixel value, and the squared pixel value is then added 1314 to the second accumulator element 706 to derive $\Sigma I^2$. Concurrently, the pixel value is added 1312 to the first accumulator element 710 to derive $\Sigma I$. If in step 1316 the pixel values for all rows of the column being calculated have not been received, the flow returns to step 1306 to receive a next pixel value.

If, on the other hand, in step 1316 the pixel values for all rows of the column being calculated have been received, then $\Sigma I$ is multiplied 1318 by two-hundred-fifty-five, as described herein above in the discussion of FIG. 7. Next, $\Sigma I^2$ is subtracted 1320 from the value obtained in step 1318, the subtraction being done by the second subtracter element 708. Then the square root of the value obtained in step 1320 is determined 1322 by the second look-up table element. The value determined in step 1322 is then multiplied 1323 by the value K received from the monitor processor 716 in the multiplier element 716. Next, the column correction factor value for the column ($K\sqrt{255\Sigma I-\Sigma I^2}$) is transmitted from the rms correction factor calculator 701 to the controller 622 over the control bus 624, after which the controller 622 stores 1324 the value in the RAM 906 at the location for storing column correction factors 910 corresponding to the calculated column.

If, in step 1326, the controller 622 determines that the calculated column is not the last column assigned to the processing system 510, then the controller 622 returns the rms correction factor calculator 701 to step 1304 to begin processing the next column of data. If, on the other hand, the controller 622 determines that the calculated column is the last column assigned to the processing system 510, then the controller 622 returns the rms correction factor calculator 701 to step 1302 to wait for the next start-processing time to arrive.

Figure 14:
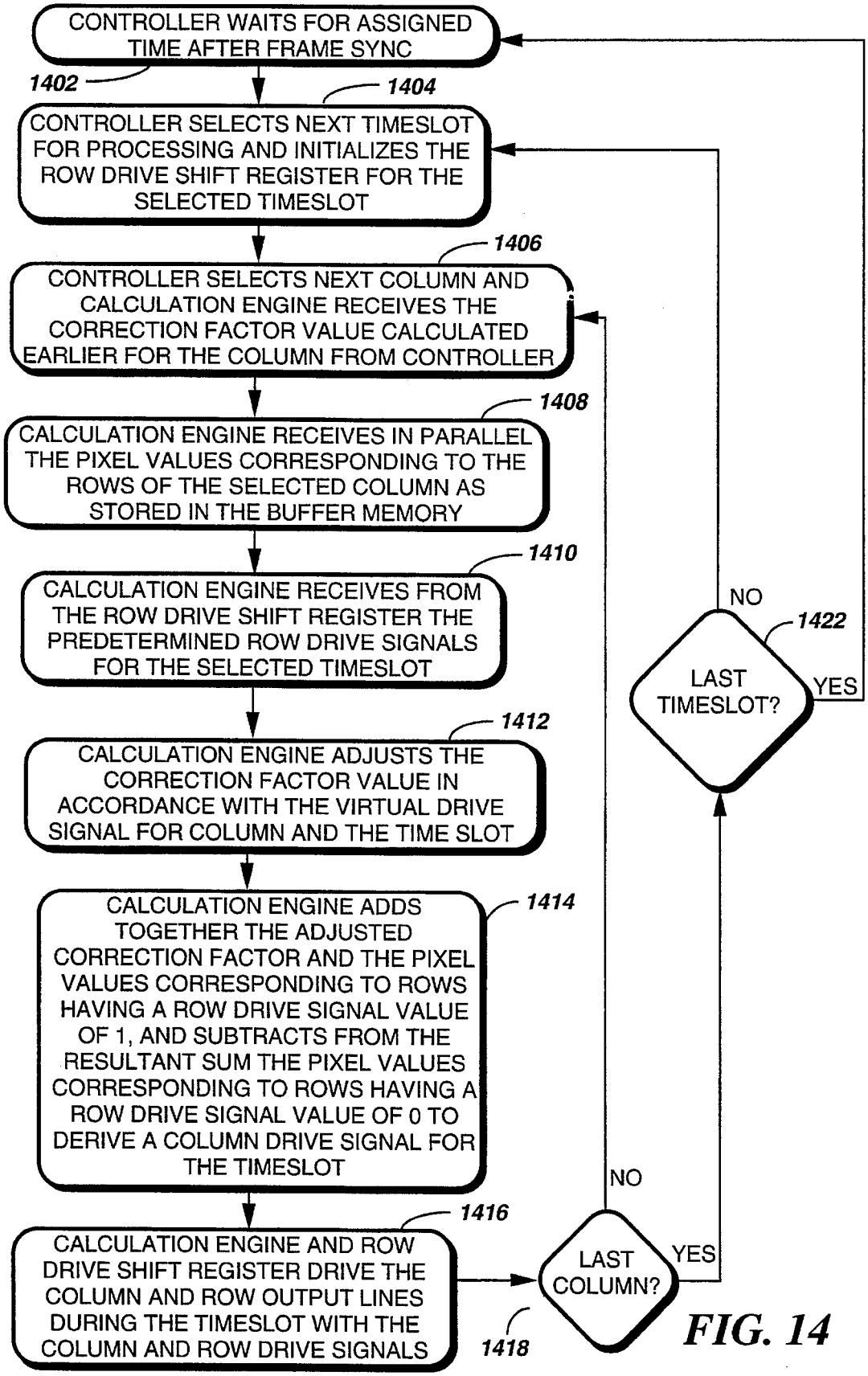
FIG. 14 is a flow chart depicting the operation of the calculation engine in accordance with the preferred embodiment of the present invention.

Referring to FIG. 14, a flow chart depicting the operation of the calculation engine 610, 612 in accordance with the preferred embodiment of the present invention begins with the controller 622 waiting 1402 after frame sync for its assigned start-processing time corresponding to the area 511 of the LCD 100 assigned to the controller 622. When the start-processing time arrives, the controller 622 selects 1404 a next time slot for processing and initializes the row drive shift register 614, 616 with Walsh function values for the time slot for each of the rows assigned to the controller 622, plus the virtual row, e.g., either one-hundred twenty-one or two-hundred-forty-one Walsh function values for the time slot, in accordance with the data resolution determined previously by the resolution monitor 700.

The controller 622 then selects 1406 a next column and retrieves from the RAM 906 and then transmits to the calculation engine 610, 612 the correction factor value calculated earlier for the selected column. Next, the controller 622 controls the buffer RAM 606, 608 to transfer 1408 in parallel to the calculation engine 610, 612 the pixel values corresponding to the rows of the selected column. Concurrently, the calculation engine 610, 612 receives 1410 from the row drive shift register 614, 616 the Walsh function values for the time slot for each of the rows assigned to the controller 622. The calculation engine 610, 612 adjusts 1412 the correction factor value in accordance with the virtual row drive signal for the selected column and the selected time slot, the adjustment made as described herein above in reference to FIG. 8.

Next, the calculation engine 610, 612 derives a column drive signal by adding 1414 together the adjusted correction factor value and the pixel values of the selected column corresponding to rows having a row drive signal of ONE, and subtracting from that sum the pixel values of the column corresponding to rows having a row drive signal of ZERO. Then the calculation engine 610, 612 and row drive shift register 614, 616 drive 1416 the column and row output lines 512, 514 during the time slot with the (calculated) column and (predetermined) row drive signals, respectively.

It is important to note that the steps 1406, 1408, 1410, 1412, and 1414 are preferably performed substantially simultaneously and in parallel to achieve optimum calculation speed. Also, as was discussed herein above in reference to FIG. 5, in the preferred embodiment of the present invention only two of the processing systems 510 are used to drive the row drive elements 506. It will be appreciated that even a single processing system 510 is sufficient to drive the row drive elements 506, because the row drive signals for corresponding rows in each of the group of two-hundred-forty rows in the top and bottom halves of the LCD 100 are predetermined and identical to one another.

In step 1418 the controller 622 checks whether the last column has been processed for the selected time slot. If not, the flow returns to step 1406 to select and process a next column. If, on the other hand, at step 1418 the last column has been processed for the selected time slot, then the controller 622 checks 1422 whether the last time slot for the frame of data has been processed. If not, the flow returns to step 1404, where the controller 622 selects a next time slot for processing. If, on the other hand, in step 1422 the last time slot for the frame of data has been processed, then flow returns to step 1402, where the controller 622 will wait to process a next frame of data.

The preceding discussion and analysis of the preferred embodiment of the present invention applies to pixel values represented by eight-bit data. It will be appreciated that the present invention can be adjusted to accommodate pixel values represented by both larger and smaller numbers of bits, e.g., sixteen-bit pixels or four-bit pixels.

Figure 15:
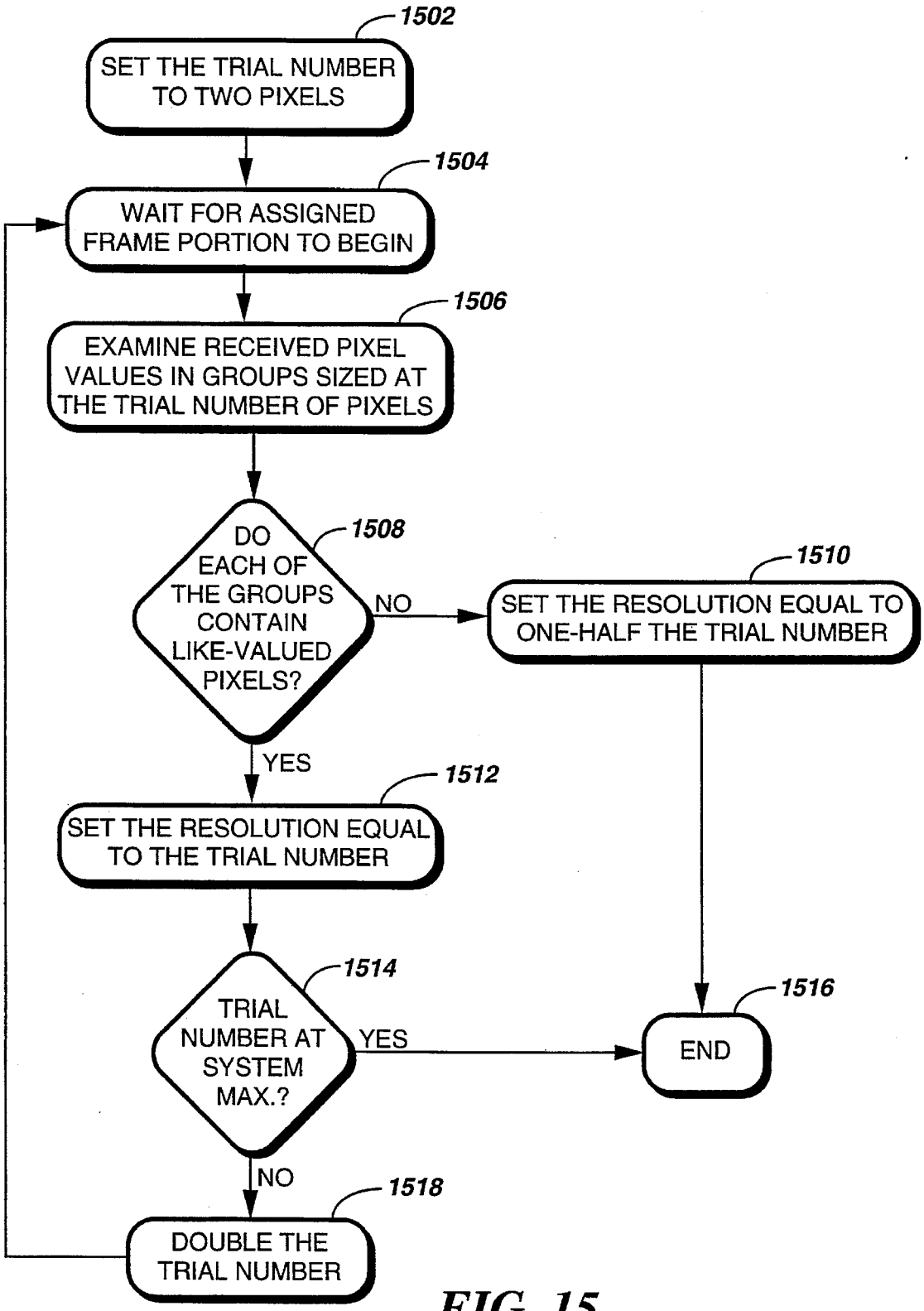
FIG. 15 is a flow chart depicting the operation of the resolution monitor in accordance with the preferred embodiment of the present invention.

Referring to FIG. 15, a flow chart depicting the operation of the resolution monitor 700 in accordance with the preferred embodiment of the present invention begins with the monitor processor 716 accessing firmware elements of the comparator 720 to set 1502 a trial number to a value of two pixels. Then the monitor processor 716 waits 1504 for its assigned frame portion to begin, as identified by the assigned frame portion identifier 732. Next, the monitor processor 716 examines 1506 received pixel values in groups sized at the trial number. When the assigned frame portion has completed, the monitor processor 716 determines 1508 whether each of the groups examined contained like-valued pixels. If not all groups contain like-valued pixels, the monitor processor 716 sets 1510 the resolution to one-half the trial number, e.g., at a value of one pixel.

If, on the other hand, in step 1508 the monitor processor 716 determines that each of the groups do contain like-valued pixels, then the monitor processor 716 sets 1512 the resolution at the trial number. Next, the monitor processor 716 checks 1514 whether the trial number is at the system maximum, i.e., the maximum resolution value for which the system can adapt. If so, the process ends 1516. If not, the monitor processor 716 doubles 1518 the trial number and returns to step 1504 to wait for the next assigned frame portion to begin.

Figure 16:
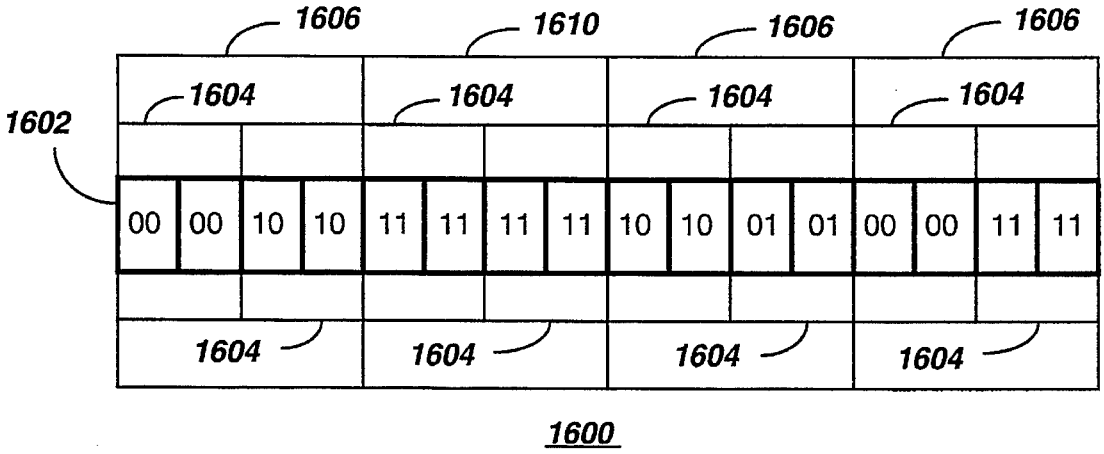
FIG. 16 is a pixel value grouping diagram depicting the manner in which the resolution monitor groups pixel values to determine resolution in accordance with the preferred embodiment of the present invention.

Referring to FIG. 16, a pixel value grouping diagram 1600 depicts the manner in which the resolution monitor 700 groups the pixel values to determine resolution in accordance with the preferred embodiment of the present invention. As described herein above, the monitor processor 700 preferably processes eight-bit pixel values, and each area 511 of the LCD 100 preferably includes one-hundred-sixty columns and two-hundred-forty rows, so that a data frame for the area 511 comprises 160×240=38,400 pixels. For simplicity, however, example pixel values 1602 are represented as two-bit values and a frame of data processed is represented as comprising sixteen of the example pixel values 1602. Of course, the monitor processor would have to be modified slightly to process the simpler example data frame structure, but the resolution determining concept remains the same.

As described above, the monitor processor 716 first groups the example pixels 1602 into groups of two pixels, as represented by the two-group boxes 1604. For the case of the example pixel values 1602, the monitor processor 716 will determine the resolution to be two pixels, because all the two-group boxes 1604 contain all-like-valued pixels. If the system were further modified to adapt for a maximum resolution of four pixels, the monitor processor 716 would also group the example pixel values 1602 into four-groups 1606, 1610 for evaluation. After evaluating the four-groups 1606, 1610, the monitor processor 716 would still determine the resolution to be two pixels, because only the four-group 1610 contains all-like-valued pixels, while the four-groups 1604 each contain mixed pixel values.

Figure 17:
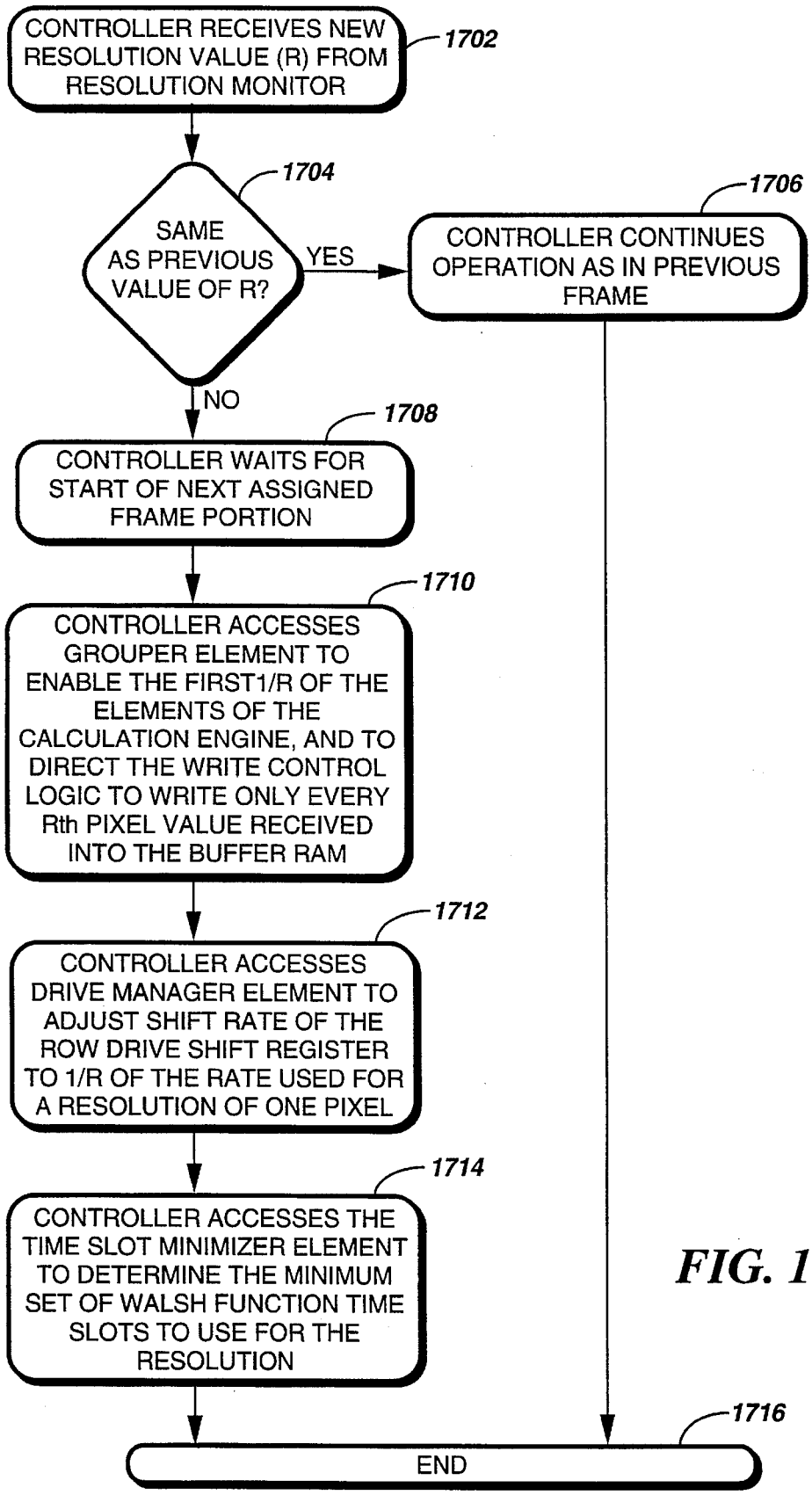
FIG. 17 is a flow chart depicting the operation of the controller in accordance with the preferred embodiment of the present invention.

Referring to FIG. 17, a flow chart depicting the operation of the controller 622 in accordance with the preferred embodiment of the present invention starts with the controller 622 receiving 1702 a new resolution value (R), for example, R=2, from the resolution monitor 700. In response, the controller 622 checks 1704 whether the new value is the same as the resolution value for the preceding frame. If so, the controller 622 continues operation using the same operational parameters used in controlling and processing the preceding frame of data. If, on the other hand, in step 1704 the controller 622 finds that the new R value is different from that of the previous frame, then the controller 622 waits 1708 for the start of the next assigned frame portion. When the assigned frame portion arrives, the controller 622 then accesses 1710 the grouper element 916 to enable the first 1/R of the elements of the calculation engine 610, 612. For example, if the new value of R is two, the controller 622 enables the XOR elements 802 and the adder elements 804 in the first half of the calculation engine 610, 612. In step 1710 the controller 622 also directs the write control logic 602, 604 to write only every Rth pixel value received into the buffer RAM 606, 608. For example, if R=2 the write control logic 602, 604 writes every second pixel value.

Next, the controller 622 accesses 1712 the drive manager 918 to adjust the shift rate of the row drive shift register 614, 616 to 1/R of the rate used for a resolution of one pixel. This will assure that the same column and row drive signals will be used to drive R adjacent columns and R adjacent rows, respectively, because clock rates of the column and row drive elements 504, 506 are NOT changed from the rates used for one-pixel resolution, thus causing R electrodes to be driven for each shift of the row drive shift register 614, 616.

Thus, the preferred embodiment of the present invention provides a method and apparatus for driving an actively addressed display in a manner that advantageously minimizes the power consumption of the required calculation engine. In addition to performing calculations in parallel for all the pixel values of a column at once instead of doing the calculations one pixel at a time, the preferred embodiment of the present invention also automatically reduces the calculation rate whenever the resolution of the received data is such that reducing the calculation rate will have no visible effect on the displayed image.

If the resolution of the received data changes from a value of 1×1 pixel to 2×2 pixels, for example, the number of column voltage calculations is automatically reduced by a factor of four. Depending on the exact circuit implementation of the processing system 510, reducing the calculation rate by a factor of four can reduce the power required to perform the calculations by substantially the same factor of four. The reduced power compared to conventional processing systems for actively addressed displays is a particularly important advantage in portable, battery-powered applications, such as laptop computers, in which long battery life is a highly desirable feature.

Figure 18:
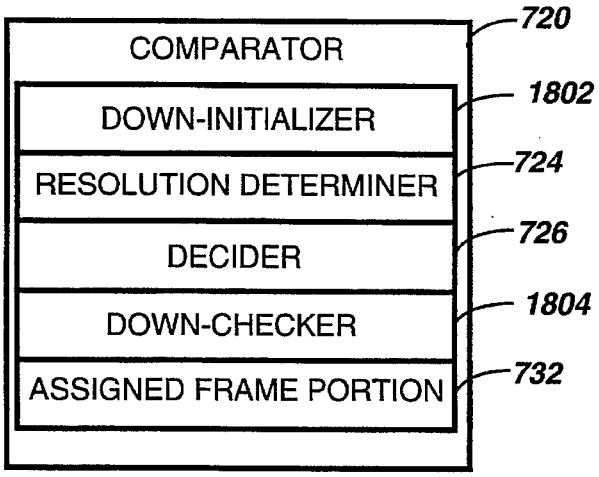
FIG. 18 is a firmware diagram depicting firmware in the resolution monitor in accordance with an alternate embodiment of the present invention.

Referring to FIG. 18, a firmware diagram 1800 depicts firmware in the resolution monitor 700 in accordance with an alternate embodiment of the present invention. The essential differences between the firmware diagram 1800 and the firmware elements depicted in FIG. 7 are the replacement of the up-initializer 722 and the up-checker 730 by a down-initializer 1802 and a down-checker 1804, respectively. The function of the replacing elements is to reverse the direction in which the resolution monitor 700 tests different values of trial number, as described herein below.

Figure 19:
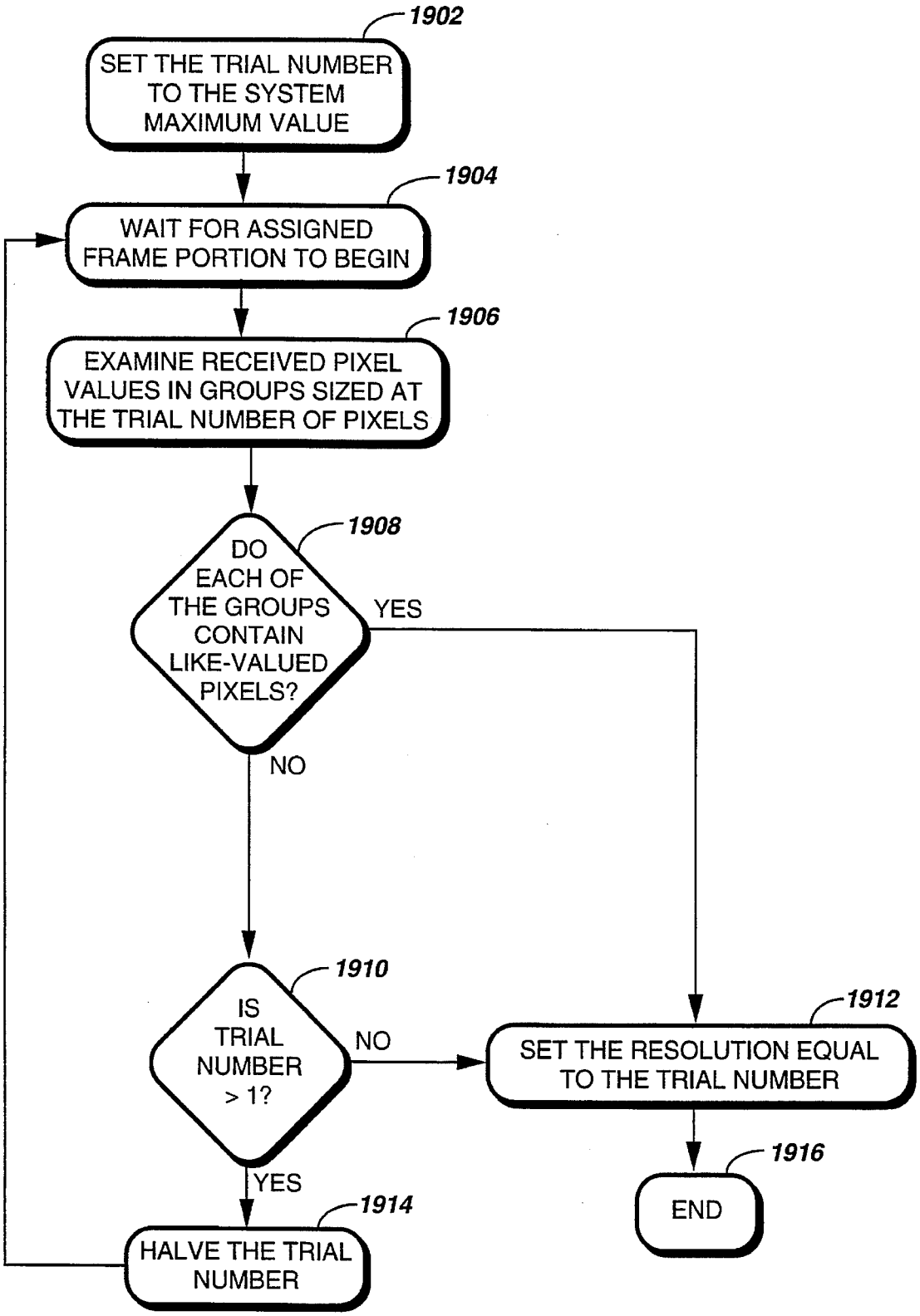
FIG. 19 is a flow chart depicting the operation of the resolution monitor in accordance with the alternate embodiment of the present invention.

Referring to FIG. 19, a flow chart depicting the operation of the resolution monitor 700 in accordance with the alternate embodiment of the present invention begins with the monitor processor 716 accessing firmware elements of the comparator 720 to set 1902 a trial number to the maximum value possible for the system. For example, a system capable of adapting calculation rate for one, two, or four pixels of resolution, would set the trial number to four. Then the monitor processor 716 waits 1904 for its assigned frame portion to begin, as identified by the assigned frame portion identifier 732. Next, the monitor processor 716 examines 1906 received pixel values in groups sized at the trial number. When the assigned frame portion has completed, the monitor processor 716 determines 1908 whether each of the groups examined contained like-valued pixels. If all groups contain like-valued pixels, the monitor processor 716 sets 1912 the resolution equal to the trial number, e.g., at a value of four pixels.

If, on the other hand, in step 1908 the monitor processor 716 determines that at least one of the groups does not contain like-valued pixels, then the monitor processor 716 checks 1910 whether the trial number is greater than unity. If not, the monitor processor 716 sets the resolution equal to the trial number and the process ends 1916. If in step 1910 the monitor processor 716 finds that the trial number is greater than unity, then the monitor processor 716 divides the trial number by two and returns to step 1904 to wait for the next assigned frame portion to begin. This alternative embodiment of the present invention is most useful for display systems in which the received data operates typically at a coarse resolution rather than a fine resolution, because the alternative embodiment begins testing with a trial number set to the coarsest possible system resolution.

Thus, both the preferred embodiment and the alternate embodiment of the present invention provide a method and apparatus for greatly reducing the calculation rate of, and thus the power consumed by, an active addressed display system. The calculation rate reduction is advantageously performed automatically in response to the resolution of the received data in a manner that reduces the calculation rate only when the reduction can be done without degrading the displayed image. The present invention is particularly advantageous in battery operated devices, such as laptop computers, which require high efficiency display systems to maximize battery life.

What is claimed is:

1. A method in a processing system which generates drive signals for driving an active addressed display during a plurality of active addressing time slots, the display having a plurality of electrodes, the drive signals being derived from electrical signals received by the processing system, the electrical signals comprising a received frame of data representing optical states of pixels of an image displayed by the active addressed display, the method enabling a minimization of power consumption of the processing system, the method comprising the steps of:

monitoring, in a resolution monitor of the processing system, pixel values in the received frame of data to be processed and displayed;

comparing, by the resolution monitor, adjacent monitored pixel values grouped into groups of equal length to measure resolution of the received frame of data; and thereafter modifying active addressing calculations utilized for driving the display in accordance with said resolution measured, to reduce power consumption of the processing system by permitting use of a reduced number of drive signals and a correspondingly reduced number of the active addressing calculations required, in response to the resolution of the received frame of data being such that modifying the active addressing calculations will have no effect on displayed resolution of the image, the modifying step comprising the steps of:

grouping by a controller, directed by grouper firmware, adjacent ones of the plurality of electrodes in accordance with said resolution measured for the received frame of data, said grouping being utilized for displaying the received frame of data in its entirety; and loading a driver, in accordance with drive manager firmware, with the grouped adjacent ones of the plurality of electrodes for generating a plurality of common drive signals for driving the active addressed display.

2. The method of claim 1, wherein said controlling step further comprises the step of selecting a minimum possible quantity of active addressing time slots in accordance with the reduced number of drive signals, thereby further reducing the power consumption of the processing system.

3. The method of claim 1, wherein said comparing step comprises the steps of:

forming, for the entire frame of data, predetermined contiguous groups of pixel values, each group containing a trial number of pixel values corresponding to adjacent pixels, the trial number starting at a predetermined initial value;

examining the pixel values in each group; and determining that said highest resolution, measured in pixels, is at least the trial number in response to finding that all the pixel values within each group are equal to one another in substantially all the groups.

4. The method of claim 3, wherein said comparing step further comprises the step of:

deciding that said highest resolution is less than the trial number in response to finding that all the pixel values within each group are equal to one another in less than substantially all the groups.

5. The method of claim 3, wherein said comparing step further comprises the steps of:

increasing each group in size to form fewer groups each containing a larger trial number of pixel values in response to finding that all the pixel values within each group are equal to one another in substantially all the groups;

repeating said examining, determining, and increasing steps until the trial number is an amount such that all the pixel values within each group are equal to one another in less than substantially all the groups; and thereafter assigning as said highest resolution of the data the trial number of largest value used by the comparing step in which all the pixel values within each group were found equal to one another in substantially all the groups.

6. The method of claim 3, wherein said comparing step further comprises the steps of:

decreasing each group in size to form additional groups each containing a smaller trial number of pixel values in response to finding that all the pixel values within each group are equal to one another in less than substantially all the groups, in response to the trial number being greater than unity before the decrease;

repeating said examining, determining, and decreasing steps until the trial number is an amount such that all the pixel values within each group are equal to one another in substantially all the groups, in response to the trial number being greater than unity;

thereafter assigning as said highest resolution of the data the trial number of largest value used by the comparing step in which all the pixel values within each group were found equal to one another in substantially all the groups, in response to the trial number being greater than unity; and assigning one pixel as said highest resolution of the data, in response to the trial number having been decreased to unity.

7. An apparatus for minimizing power consumption of a processing system which generates drive signals for driving an active addressed display during a plurality of active addressing time slots, the display having a plurality of electrodes, the drive signals being derived from electrical signals received by the processing system, the electrical signals comprising a received frame of data representing optical states of pixels of an image displayed by the active addressed display, the apparatus comprising:

a resolution monitor for monitoring pixel values in the received frame of data to be processed and displayed;

a comparator coupled to the resolution monitor for comparing adjacent monitored pixel values grouped into groups of equal length to measure resolution of the received frame of data;

a driver coupled to a controller for driving the active addressed display; and the controller coupled to the comparator for modifying active addressing calculations utilized for driving the display in accordance with said resolution measured, to reduce power consumption of the processing system by permitting use of a reduced number of drive signals and a correspondingly reduced number of the active addressing calculations required, in response to the resolution of the received frame of data being such that modifying the active addressing calculations will have no effect on displayed resolution of the image, the controller comprising:

a grouper for grouping adjacent ones of the plurality of electrodes in accordance with said resolution measured for the received frame of data, said grouping being utilized for displaying the received frame of data in its entirety; and a drive manager coupled to the grouper for loading a driver with the grouped adjacent ones of the plurality of electrodes for generating a plurality of common drive signals for driving the active addressed display.

8. The apparatus of claim 7, wherein said controller further comprises:

a time slot minimizer coupled to the drive manager for selecting a minimum possible quantity of active addressing time slots in accordance with the reduced number of drive signals, thereby further reducing the power consumption of the processing system.

9. The apparatus of claim 7, wherein said comparator comprises:

an initializer for forming, for the entire frame of data, predetermined contiguous groups of pixel values, each group containing a trial number of pixel values corresponding to adjacent pixels, the trial number starting at a predetermined initial value;

a resolution determiner coupled to the initializer for examining the pixel values in each group and determining that said highest resolution, measured in pixels, is at least the trial number in response to finding that all the pixel values within each group are equal to one another in substantially all the groups.

10. The apparatus of claim 9, wherein said comparator further comprises a decider for deciding that said highest resolution is less than the trial number in response to finding that all the pixel values within each group are equal to one another in less than substantially all the groups.

11. The apparatus of claim 9, wherein said comparator further comprises an up-checker coupled to the resolution determiner for increasing each group in size to form fewer groups each containing a larger trial number of pixel values in response to finding that all the pixel values within each group are equal to one another in substantially all the groups, and further for repeating resolution determination while increasing the trial number until the trial number is an amount such that all the pixel values within each group are equal to one another in less than substantially all the groups.

12. The apparatus of claim 9, wherein said comparator further comprises a down-checker coupled to the resolution determiner for decreasing each group in size to form additional groups each containing a smaller trial number of pixel values in response to finding that all the pixel values within each group are equal to one another in less than substantially all the groups, in response to the trial number being greater than unity before the decrease.

13. The apparatus of claim 12, wherein said down-checker repeats resolution determination while decreasing the trial number until the trial number is an amount such that all the pixel values within each group are equal to one another in substantially all the groups, in response to the trial number being greater than unity.

14. The apparatus of claim 12, wherein said down-checker assigns as said highest resolution of the data the trial number of a largest value used by the comparator means in which all the pixel values within each group were found equal to one another in substantially all the groups, in response to the trial number being greater than unity, and assigns one pixel as said highest resolution of the data, in response to the trial number having been decreased to unity.

15. An electronic device, comprising:

electronic circuitry for generating electrical signals comprising a received frame of data having a resolution, the received frame of data representing optical states of pixels of an image displayed by an active addressed display;

an enclosure coupled to the electronic circuitry for supporting and protecting the electronic circuitry;

the active addressed display coupled to the electronic circuitry for displaying information therefrom, wherein the active addressed display comprises pixels controlled by a plurality of electrodes;

a processing system coupled to the electronic circuitry, the processing system developing drive signals from the electrical signals, the drive signals for driving the active addressed display during a plurality of active addressing time slots; and an apparatus for minimizing power consumption of the processing system, the apparatus comprising:

a monitor for monitoring pixel values in the received frame of data;

a comparator coupled to the monitor for comparing adjacent monitored pixel values grouped into groups of equal length to measure said resolution of the received frame of data;

a driver coupled to a controller for driving the active addressed display; and the controller coupled to the comparator for modifying active addressing calculations utilized for driving the display in accordance with said resolution measured by the comparator, to reduce power consumption of the processing system by permitting use of a reduced number of drive signals and a correspondingly reduced number of the active addressing calculations required, in response to the resolution of the received frame of data being such that modifying the active addressing calculations will have no effect on displayed resolution of the image., the controller comprising:

a grouper for grouping adjacent ones of the plurality of electrodes in accordance with said resolution measured, said grouping being utilized for displaying the received frame of data in its entirety; and a drive manager coupled to the grouper for loading the driver with the grouped adjacent ones of the plurality of electrodes for generating a plurality of common drive signals for driving the active addressed display.

16. The electronic device of claim 15, wherein said controller further comprises:

a time slot minimizer coupled to the drive manager for selecting a minimum possible quantity of active addressing time slots in accordance with the reduced number of drive signals, thereby further reducing the mean calculation rate.

17. The electronic device of claim 15, wherein said comparator comprises:

an initializer for forming, for the entire frame of data, predetermined contiguous groups of pixel values, each group containing a trial number of pixel values corresponding to adjacent pixels, the trial number starting at a predetermined initial value;

a resolution determiner coupled to the initializer for examining the pixel values in each group and determining that said highest resolution, measured in pixels, is at least the trial number in response to finding that all the pixel values within each group are equal to one another in substantially all the groups.

18. The electronic device of claim 17, wherein said comparator further comprises a decider for deciding that said highest resolution is less than the trial number in response to finding that all the pixel values within each group are equal to one another in less than substantially all the groups.

19. The electronic device of claim 17, wherein said comparator further comprises an up-checker coupled to the resolution determiner for increasing each group in size to form fewer groups each containing a larger trial number of pixel values in response to finding that all the pixel values within each group are equal to one another in substantially all the groups, and further for repeating resolution determination while increasing the trial number until the trial number is an amount such that all the pixel values within each group are equal to one another in less than substantially all the groups.

20. The electronic device of claim 17, wherein said comparator further comprises a down-checker coupled to the resolution determiner for decreasing each group in size to form additional groups each containing a smaller trial number of pixel values in response to finding that all the pixel values within each group are equal to one another in less than substantially all the groups, in response to the trial number being greater than unity before the decrease.

21. The electronic device of claim 20, wherein said down-checker repeats resolution determination while decreasing the trial number until the trial number is an amount such that all the pixel values within each group are equal to one another in substantially all the groups, in response to the trial number being greater than unity.

22. The electronic device of claim 20, wherein said down-checker assigns as said highest resolution of the data the trial number of largest value used by the comparator in which all the pixel values within each group were found equal to one another in substantially all the groups in response to the trial number being greater than unity, and assigns one pixel as said highest resolution of the data in response to the trial number having been decreased to unity.

* * * * *